US009248896B2

(12) United States Patent
Bergman

(10) Patent No.: US 9,248,896 B2
(45) **Date of Patent: *Feb. 2, 2016**

(54) PADDLE

(71) Applicant: Ronald Wayne Bergman, Kamuela, HI (US)

(72) Inventor: Ronald Wayne Bergman, Kamuela, HI (US)

( * ) Notice: Subject to any disclaimer, the term of this patent is extended or adjusted under 35 U.S.C. 154(b) by 58 days.

This patent is subject to a terminal disclaimer.

(21) Appl. No.: 14/174,045

(22) Filed: Feb. 6, 2014

(65) Prior Publication Data

US 2014/0271224 A1 Sep. 18, 2014

Related U.S. Application Data

(63) Continuation of application No. 13/803,560, filed on Mar. 14, 2013, now Pat. No. 8,684,778.

(51) Int. Cl.
*B63H 16/04* (2006.01)

(52) U.S. Cl.
CPC ..... *B63H 16/04* (2013.01); *B63B 2221/20* (2013.01)

(58) Field of Classification Search
CPC ..... B63H 16/04; B63H 16/08; B63H 16/10; B63H 16/12; B63H 16/16; B63H 16/20; B63H 16/073; B63B 2221/20; B63B 2221/22
USPC ..... 440/101, 102; 416/69, 70 R, 72, 78
See application file for complete search history.

(56) References Cited

U.S. PATENT DOCUMENTS 1,777,749 A * 10/1930 Eguiluz ..... B63H 16/12 440/100
2,367,222 A * 1/1945 Kurtz ..... B63H 16/04 403/91
2,492,918 A * 12/1949 Grierson ..... B63H 16/04 416/238
2,566,023 A * 8/1951 Gagnon ..... B63H 16/04 416/74
2,590,991 A * 4/1952 McDonald ..... B63H 16/04 16/221
3,037,219 A * 6/1962 Webb ..... B63H 16/04 416/240
3,153,797 A * 10/1964 Drennen, Jr. ..... B63H 16/04 416/63
3,347,575 A 10/1967 Morris
3,411,166 A * 11/1968 Kimmel ..... B63B 27/146 182/196

(Continued)

OTHER PUBLICATIONS

USPTO, PCT Search Report and Written Opinion, PCT/US14/18149, Aug. 15, 2014.

*Primary Examiner* — Anthony Wiest
(74) *Attorney, Agent, or Firm* — Leveque Intellectual Property Law, P.C.

(57) ABSTRACT

A paddle device. First and second paddle assemblies each have a paddle blade extending from a paddle end of a paddle arm so that the paddle structures each have a paddle blade end and a paddle arm end. A hand crankable crank shaft arrangement have a center and first and second ends and having handle segments. The paddle arm end of the first paddle structure is coupled to the first end of the crank shaft arrangement and the paddle arm end of the second paddle structure is coupled to the second end of the crank shaft arrangement. First and second handle grips are rotatably coupled to the crank shaft arrangement so as to permit the crank shaft arrangement to rotate with respect to the first and second handle grips when the crankshaft arrangement is cranked. This abstract is not to be considered limiting.

18 Claims, 16 Drawing Sheets

(56) References Cited

U.S. PATENT DOCUMENTS

| | | | | | |
|---|---|---|---|---|---|
| 3,580,213 | A | * | 5/1971 | Yuen | A63B 35/04 416/86 |
| 4,605,378 | A | * | 8/1986 | Hamilton | B63H 16/04 16/429 |
| 4,701,142 | A | * | 10/1987 | Merritt | B63H 16/04 16/426 |
| 4,726,550 | A | * | 2/1988 | Chen | A63B 35/04 244/118.6 |
| 4,820,216 | A | * | 4/1989 | Masters | B63H 16/04 416/70 R |
| 4,832,631 | A | * | 5/1989 | Gag | 440/26 |
| 4,979,916 | A | * | 12/1990 | LeBlanc | 440/27 |
| D320,375 | S | * | 10/1991 | Bruce | D12/215 |
| 5,114,371 | A | | 5/1992 | Alonzo | |
| 2007/0015420 | A1 | | 1/2007 | Vartanian | |
| 2012/0244763 | A1 | | 9/2012 | Cregan | |
| 2013/0045099 | A1 | | 2/2013 | Bicknell | |

* cited by examiner

FIG. 15(c)
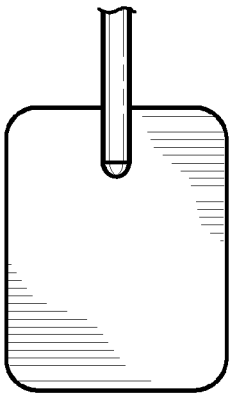
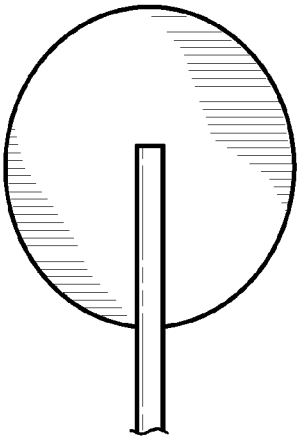
FIG. 15(b)
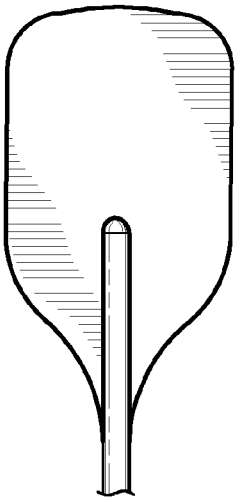
FIG. 15(a)
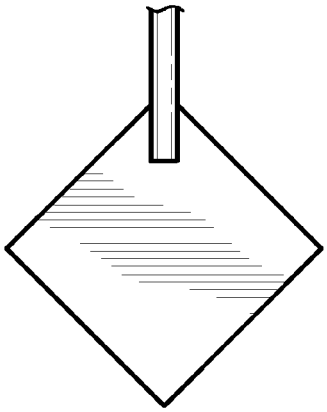
FIG. 15(d)
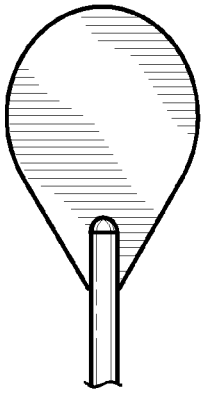
FIG. 15(e)
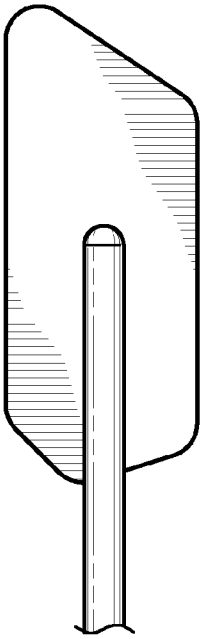
FIG. 15(f)
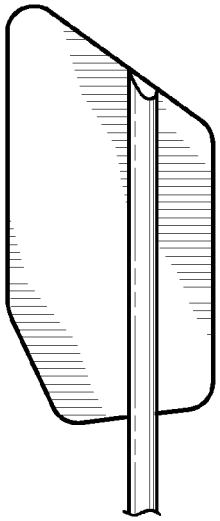
FIG. 15(g)

FIG. 19
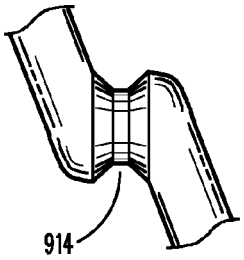
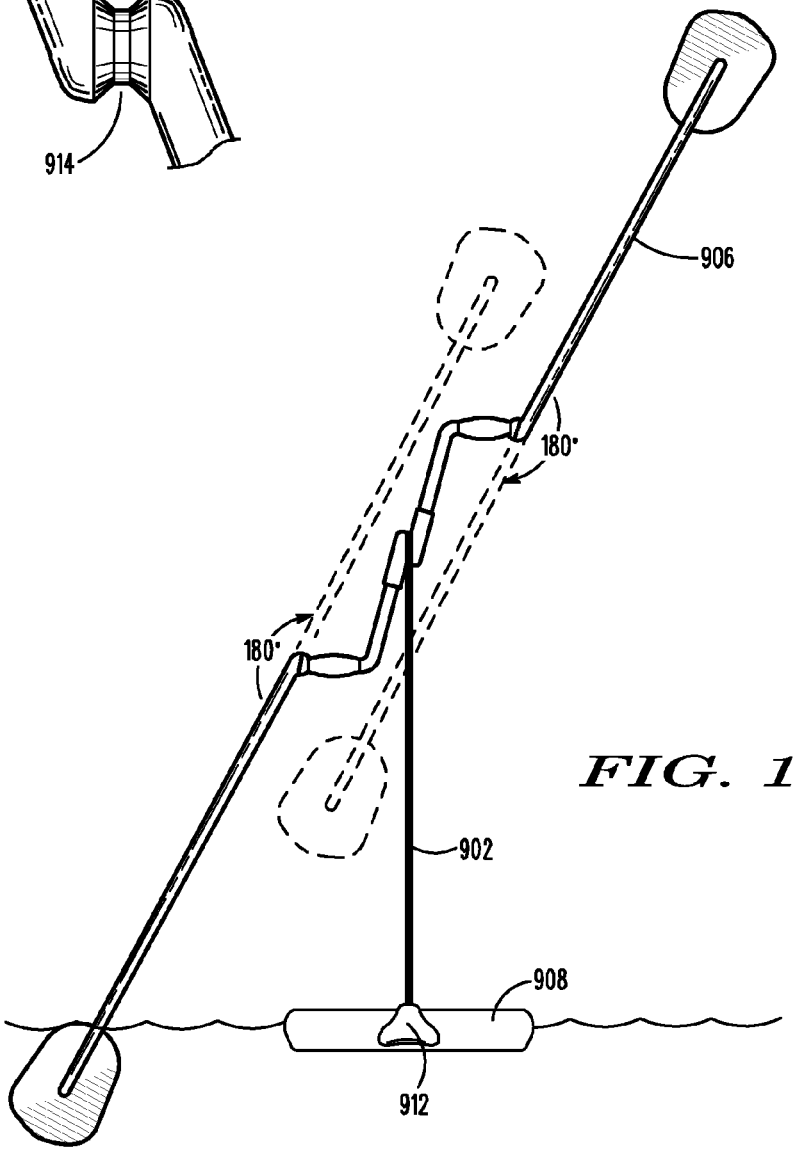
FIG. 18

PADDLE

PRIORITY CLAIM

This application is a continuation of the application entitled "PADDLE", application Ser. No. 13/803,560 filed on Mar. 14, 2013 now U.S. Pat. No. 8,684,778 issued Apr. 1, 2014. This prior application, including the entire written description and drawing figures, are hereby incorporated into the present application by reference.

COPYRIGHT AND TRADEMARK NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever. Trademarks are the property of their respective owners.

BACKGROUND

Conventional hand-held paddles used, for example, in stand-up surfboarding and the like are more or less conventional double ended paddles having paddle blades connected together with an elongated handle. Consider, for example, a stand-up surfboard application. When the user paddles with such a paddle, the paddling motion generally involves a movement of the user's body from an upright position to some level of a bent over position as the paddle is alternately engaged into the water on the left and right of the user. This change from the upright position to the bent over position substantially alters the user's center of gravity from substantially vertically aligned from head between foot positions when upright, to a position substantially forward of that position when the user is in the bent over position.

Especially in the case of a beginner or student user, this movement translates to a shift in the balance point of the user on the surfboard tipping the surfboard from front to back. Additionally, as the user engages the paddle blades with the water alternately on the left and right, the alternating left and right motion creates a rocking motion alternating from the left to the right of the user's body that is translated to a rocking motion of the surfboard. As a result, a person attempting to learn to paddle a stand-up surfboard or the like is faced with the challenge of maintaining balance on the surfboard while shifting his or her balance to paddle. The paddling action is inherently disruptive of the balance of the user and can render learning to paddle a stand-up surfboard quite a challenge.

BRIEF DESCRIPTION OF THE DRAWINGS

Example embodiments of the present disclosure will be described below with reference to the included drawings such that like reference numerals refer to like elements and in which:

FIG. 10, which is made up of FIG. 10*a*, FIG. 10*b

FIG. 15 is made up of FIG. 15*a* through FIG. 15*g*. FIG. 15*a* depicts an illustrative traditional shaped paddle blade. FIG. 15*b* depicts an illustrative round shaped paddle blade. FIG. 15*c* depicts an illustrative square shaped paddle blade. FIG. 15*d* depicts an illustrative diamond shaped paddle blade. FIG. 15*e* depicts an illustrative tear-drop shaped paddle blade. FIG. 15*f* depicts an illustrative asymmetrical somewhat polygon shaped paddle blade. FIG. 15*g* depicts another illustrative asymmetrical polygon paddle blade.

FIG. 18 illustrates an example of another variation of a paddle having a tether rotatably coupled to the center portion of the paddle in a manner consistent with certain embodiments.

FIG. 19 shows an example detail of the bearing surface for the tether in the embodiment of the paddle depicted in FIG. 18.

DETAILED DESCRIPTION

Figures 1, 2, 3:
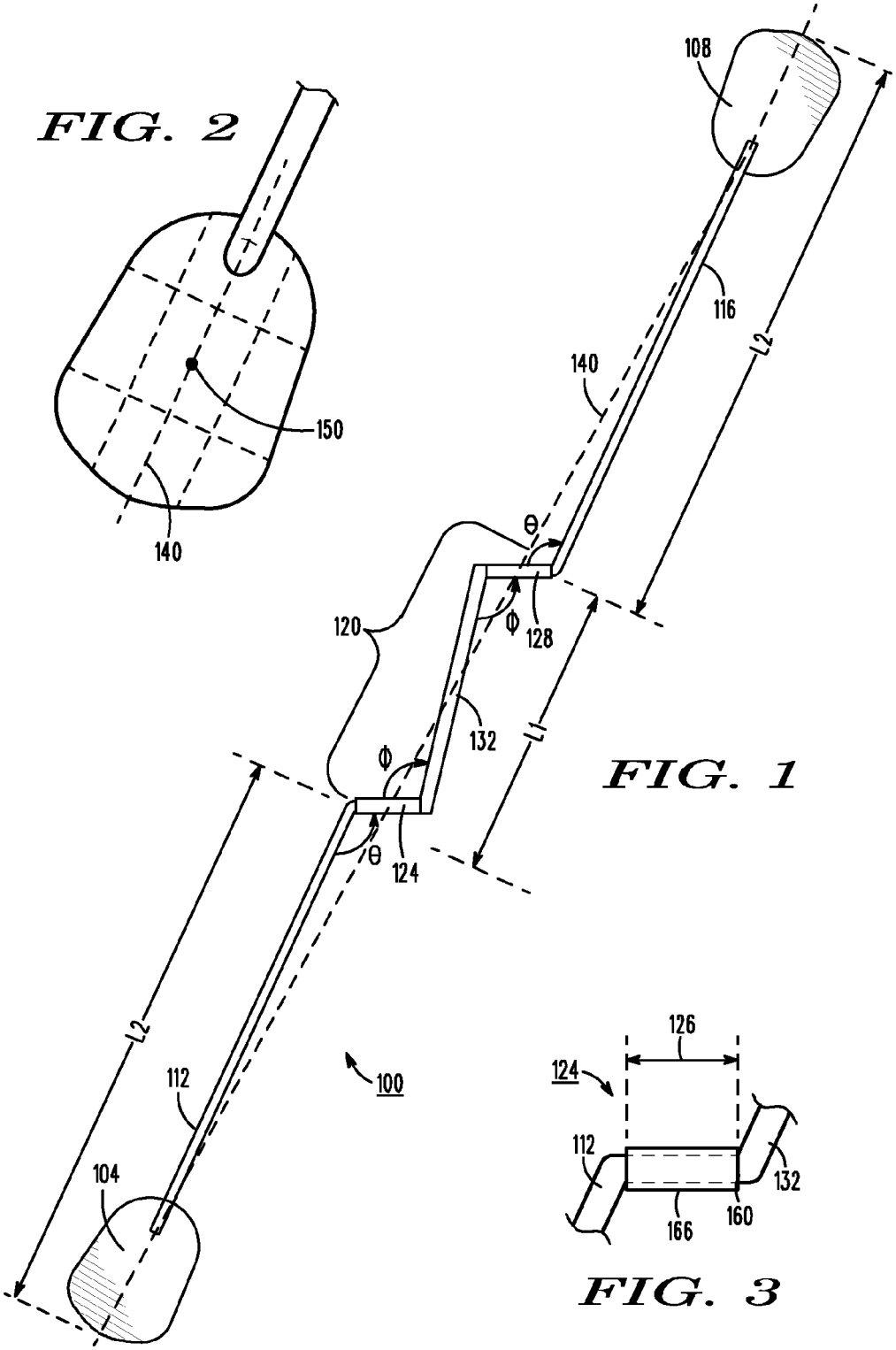
FIG. 1 is an example of an implementation of a paddle consistent with certain embodiments of the disclosure.
FIG. 2 is an example of a paddle blade showing a central ⅓ of the paddle blade about a center of mass of the paddle blade of a paddle consistent with certain embodiments of the disclosure.
FIG. 3 is an example of an implementation of a rotating handle grip used in a paddle consistent with certain embodiments of the disclosure.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The invention is not to be considered as limited to the scope of the embodiments described herein.

While this invention is susceptible of embodiment in many different forms, there is shown in the drawings and will herein be described in detail several specific embodiments, with the understanding that the present disclosure of such embodiments is to be considered as an example of the principles and not intended to limit the invention to the specific embodiments shown and described.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically. Reference throughout this document to "one embodiment", "certain embodiments", "an embodiment", "an implementation" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

The type of paddle discussed herein is the type which is supported by being held in the hands of the user thereof (i.e., hand-held) and not the single ended type that uses an oar-lock or similar pivoting structures as a fulcrum or otherwise supporting a paddle device in the act of paddling a boat. While the paddle is discussed in detailed examples relating to a stand-up surfboard, the paddle can be used with any suitable vessel including but not limited to a stand-up surfboard, an outrigger canoe, a canoe, a kayak or other vessel while the user is either standing or seated without limitation.

For purposes of this document, in order to define the physical relationship between the various elements of the present paddle, it is useful to think of the various elements as being two dimensional. If that were actually the case, the various elements of the paddle would all lie in a single plane. In real world implementations, however, the various elements are three dimensional, thus having thickness. Accordingly, the intent is that the term "the same plane" actually means that the various elements of the paddle can be situated within two closely spaced substantially parallel planes and still be within the meaning of the terms same plane or approximately or substantially the same plane.

In a similar manner, the various elements of the paddle blade or the various paddle segments may contain angled, curved or cupped elements such as curved paddle arms or, curved or cupped paddle blades, or the paddle blades may be angled somewhat (e.g., such as up to about 30 degrees) or offset somewhat (e.g., within about approximately four inches) without departing from the above definition of being in substantially the same plane. Additionally, the paddle blades may incorporate ribs or other strengthening structural elements that do not exactly align with the plane, and the paddle arms may be attached to a surface of the paddle blade, thereby slightly offsetting the blade. It is to be understood that while such variants vary from a strict definition of a plane, the use of this terminology is useful to understanding the approximate alignment of the various segments of the paddle. Hence, this term should be construed loosely and encompass elements that are approximately aligned within two closely spaced planes as described above.

In the present discussion the terms "center of gravity" or "center of mass", which can be used interchangeably, are in reference to an approximate central area or center point of a paddle blade. Since paddle blades can be configured in any number of shapes including a traditional somewhat elongated tear-drop shape or a triangular, polygonal, square, diamond shaped, circular, oval shape or irregular shape, defining such central point or center area is complicated somewhat. However, this central area generally approximates the center of mass of a two dimensional view of the paddle surface. When the present paddle is in use, in certain example implementations there can be an alignment of the various paddle segments with a central area of the paddle blade surface and this central area is generally near the paddle blade's center of mass. This term should also be considered approximate and exclude any structural ribs or mounting structures for connection of the paddle arms or other elements of the paddle blade that do not relate to the basic shape of a projection of the paddle blade itself viewed in two dimensions. Moreover, there is not usually strictly a single attachment point between the paddle arm and the paddle blade, but structurally, the operational paddle arm typically extends to near a central portion (which would correspond to a center of mass of a uniform thickness rendition of a planar paddle blade) or perhaps extend beyond the central portion.

Moreover, when optimizing certain example embodiments of the paddle blade, the relevant portion of the paddle blade for computation of the center of mass may be that portion that is submerged during the most powerful portion of a paddle stroke. This term should also be considered approximate in nature and is intended to represent an approximate center of a useful portion of a paddle blade in paddling. An approximation of this location is within approximately the central ⅓ of the paddle blade's surface surrounding the actual center of mass as measured from side to side of the paddle blade and as measured along the length of the paddle blade.

Numerical terms such as "first", "second", etc. as used herein have no significance except for use as labels to facilitate description. Hence, although a segment may be described to have "first" and "second" ends, the terms are only used herein as names to distinguish one end from the other in the description without further significance.

It is further noted that the stiffness of the paddle blade factors into a determination of where the paddle arm ends and the paddle blade begins. If the paddle blade is sufficiently stiff, then for purposes of this document the paddle blade itself can be considered an extension of the paddle arm. Hence, for example, with a rigid circular paddle blade, the paddle arm could be attached to the circumference of the circle pointing toward the center and the portion of the paddle blade between the attachment point and the center would act to effectively extend the paddle arm to the center of mass of the paddle blade.

In certain example implementations a "center line" is also discussed with this center line being an indication of the alignment of portions of the paddle structure. This center line should be considered as an "imaginary" line through a two dimensional plan view (i.e. a two dimensional projection of the paddle) of the paddle structure from above or below. Moreover, a deviation from the exact center line is acceptable but preferably the center line passes through approximately the central third of the paddle blade as discussed above. Therefore, in accordance with certain aspects of the present disclosure, there is provided a paddle device having a first and a second paddle blade. A crank shaft arrangement has a first handle segment with a first end and a second end. A center portion has a first end and a second end, and a second handle segment has a first end and a second end. The first end of the first handle segment is coupled to the first end of the center portion. The first end of the second handle segment is coupled to the second end of the center portion, and the first handle segment, second handle segment and the center portion are aligned in substantially the same plane to form the crank shaft arrangement. A first paddle arm and a second paddle arm, each having first and second paddle arm ends. The first end of the first paddle arm is coupled to the first paddle blade, and the second end of the first paddle arm is coupled to the second end of the first handle segment. The first end of the second paddle arm is coupled to the second paddle blade, and the second end of the second paddle arm is coupled to the second end of the second handle segment. A first and a second handle grip are coupled to the first and second handle segments respectively in a manner that allows the first and second handle segments to rotate within the first and second handle grips respectively.

In certain implementations, the first and second paddle blades and the first and second paddle arms are aligned in substantially the same plane as the plane of the crank shaft arrangement. In certain implementations, the paddle is aligned such that a center line passes substantially through a center of mass of the first and second paddle blades, and substantially through a center of the first and second handle segments and substantially through a center of the center portion. In certain implementations, the center portion is adjustable in length. In certain implementations, the center portion has an inner segment having a spring button and an outer segment having a sequence of holes so that the center portion is incrementally adjustable in length by engaging the spring button in one of the sequence of holes. In certain implementations, the center portion has an inner segment and an outer segment, and furthermore has a twist lock mechanism that locks the inner segment to the outer segment, where the center portion is adjustable in length and is adjusted by locking the twist lock to produce a center portion of a particular length. In certain implementations, the first end of the first handle segment is coupled to the first end of the center portion at a first obtuse angle, and the first end of the second handle segment is coupled to the second end of the center portion at a second obtuse angle.

In certain implementations, the first end of the first paddle arm is coupled to the first paddle blade, and the second end of the first paddle arm is coupled to the second end of the first handle segment at a third obtuse angle; and the first end of the second paddle arm is coupled to the second paddle blade, and the second end of the second paddle arm is coupled to the second end of the second handle segment at a fourth obtuse angle. In certain implementations, the first and second paddle arms are adjustable in length. In certain implementations, each of the first and second paddle arms have an inner segment having a spring button and an outer segment having a sequence of holes so that the paddle arms are incrementally adjustable in length by engaging the spring button in one of the sequence of holes. In certain implementations, the first and second paddle arms each have an inner segment and an outer segment, and further have a twist lock mechanism that locks the inner segment to the outer segment where the first and second paddle arms are adjustable in length and are adjusted by locking the twist locks to produce first and second paddle arms of a particular length. In certain implementations, the angles between first and second paddle arms and first and second handle segments respectively are adjustable angles. In certain implementations, the first and second handle grips are configured to pivot about a central region of the first and second handle segments while the first and second handle segments rotate with respect to the first and second handle grips respectively. In certain implementations, a tether is rotatably coupled to the center portion. In certain implementations, the tether is configured to be coupled to a floating vessel. In certain implementations, a float is coupled to the paddle. In certain implementations, the paddle is adjustable between an operative position and a folded position.

In another implementation. a paddle device has a first and a second paddle structure each having a paddle blade extending from a paddle end of a paddle arm so that the first and second paddle structures each have a paddle blade end and a paddle arm end. A hand crankable crank shaft arrangement has a center and first and second ends and has handle segments. The paddle arm end of the first paddle structure is coupled to the first end of the hand crankable crank shaft arrangement, and the paddle arm end of the second paddle structure is coupled to the second end of the hand crankable crank shaft arrangement. First and second handle grips are rotatably coupled to the hand crankable crank shaft arrangement so as to permit the crankshaft to rotate with respect to the first and second handle grips when the hand crankable crankshaft arrangement is cranked.

In certain implementations, the paddle is aligned such that a center line passes substantially through a center of mass the first and second paddle blades and further passes substantially through a center of the first and second handle segments. In certain implementations, the hand crankable crank shaft arrangement is adjustable in length. In certain implementations, the paddle arm ends of the first and second paddle structures are attached to the hand crankable crankshaft at obtuse angles. In certain implementations, the first and second paddle arms are adjustable in length. In certain implementations, the paddle arm ends of the first and second paddle structures are attached to the hand crankable crankshaft at angles that are adjustable. In certain implementations, a tether is rotatably coupled to the center portion and the tether is configured to be coupled to a floating vessel. In certain implementations, a float is coupled to the paddle. In certain implementations, the paddle is adjustable between an operative position and a folded position.

Another paddle device has a first and a second paddle blade. A hand crankable crank shaft arrangement has first and second ends and has handle segments. A first paddle arm and a second paddle arm each have first and second ends. The first end of the first paddle arm is coupled to the first paddle blade, and the second end of the first paddle arm is coupled to the second end of the hand crankable crank shaft arrangement. The second end of the second paddle arm is coupled to the second paddle blade. The first end of the second paddle arm is coupled to the first end of the hand crankable crank shaft arrangement. First and second handle grips are rotatably coupled to the crank shaft arrangement so as to permit the hand crankable crankshaft to rotate with respect to the first and second handle grips when the hand crankable crankshaft arrangement is cranked. The paddle is arranged in a manner such that a center line passes substantially through a center of mass of the first and second paddle blades and substantially through a center of the first and second handle grips and substantially through a center of the hand crankable crank shaft arrangement.

In certain implementations, the hand crankable crank shaft arrangement has a first handle segment with a first end and a second end; a center portion having a first end and a second end; and a second handle segment having a first end and a second end. In certain implementations, the first end of the first handle segment is coupled to the first end of the center portion at a first obtuse angle, and the first end of the second handle segment is coupled to the second end of the center portion at a second obtuse angle, and the first handle segment, second handle segment and the center portion are aligned in substantially the same plane to form the crank shaft arrangement. In certain implementations, the center portion is adjustable in length.

In certain implementations, the second end of the first paddle arm is coupled to the second end of the hand crankable crank shaft arrangement at a third obtuse angle, and where the first end of the second paddle arm is coupled to the first end of the crank shaft arrangement at a fourth obtuse angle. In certain implementations, the third and fourth angles between first and second paddle arms and the hand crankable crank shaft arrangement are adjustable angles. In certain implementations, the first and second paddle arms are adjustable in length. In certain implementations, the angles between first and second paddle arms and first and second handle segments respectively are adjustable angles. In certain implementations, a tether is rotatably coupled to the center portion. In certain implementations, the tether is configured to be coupled to a floating vessel. In certain implementations, a float is coupled to the paddle. In certain implementations, the paddle is adjustable between an operative position and a folded position.

Another paddle device has a first and a second paddle blade. A hand crankable crank shaft arrangement has first and second ends and has handle segments. A first paddle arm and a second paddle arm are provided, where each of the first and second paddle arms have first and second ends. The first end of the first paddle arm is coupled to the first paddle blade with the paddle blade extending outward from the paddle arm and the second end of the first paddle arm is coupled to the second end of the hand crankable crank shaft arrangement. The second end of the second paddle arm is coupled to the second paddle blade with the blade extending outward from the paddle arm, and the first end of the second paddle arm is coupled to the first end of the hand crankable crank shaft arrangement. First and second handle grips are rotatably coupled to the hand crankable crank shaft arrangement so as to permit the hand crankable crankshaft to rotate with respect to the first and second handle grips when the hand crankable crank shaft arrangement is cranked. Another paddle device has first and second paddle assemblies that each have a single paddle blade extending from a paddle end of a paddle arm so that the first and second paddle structures each have a paddle blade end and a paddle arm end. A hand crankable crank shaft arrangement has a center and first and second ends and handle segments. The paddle arm end of the first paddle structure is coupled to the first end of the hand crankable crank shaft arrangement and the paddle arm end of the second paddle structure is coupled to the second end of the hand crankable crank shaft arrangement. First and second handle grips are rotatably coupled to the hand crankable crank shaft arrangement so as to permit the crank shaft to rotate with respect to the first and second handle grips when the hand crankable crankshaft arrangement is cranked.

FIG. 1 is an illustration of an example paddle 100 in accordance with aspects consistent with the present disclosure. In this example, more or less conventional paddle blades 104 and 108 are coupled to a pair of paddle arms to produce paddle arm structures 112 and 116 (which may be of unified construction or may constitute an assembly). These paddle arm structures 112 and 116 thus each incorporate a paddle arm coupled to a single paddle blade extending outward from the ends thereof. The paddle arm structures 112 and 116 are coupled to a hand crankable crankshaft arrangement 120 (the crankshaft). The crankshaft 120 is made up of two handle segments 124 and 128 separated and connected by a center portion or connecting portion 132. Each of the handle segments 124 and 128 preferably incorporate handle grips that are configured such that the crankshaft's handle segments rotate within the handle grips when the crankshaft is cranked.

In certain example implementations, each paddle arm 112 and 116 is situated at an angle of approximately θ degrees to the handle segments 124 and 128 and each handle segment is situated at an angle to the center portion 132 of approximately ϕ degrees. In each case the angles may be fixed or user configurable or adjustable, depending upon the implementation. The center portion 132 has length L1 and each paddle arm structure has length L2 where L1 and L2 may either be fixed or user configurable or adjustable.

If the paddle 100 is considered to be approximately planar so that all of the elements reside approximately in the same plane, the angles θ and ϕ are generally, but not necessarily, obtuse angles. The lengths L1 and L2 depend upon the height and size of the user. As a starting point rule of thumb, L1 can be approximated as the user's height divided by three. L2 can be approximated as two times L1 or ⅔ of the user's height. So, for example, a good starting point for sizing a paddle for an example user who is 6'0" in height (72") is approximately L1=24 inches and L2=48 inches. This makes the overall length of the paddle about 120 inches. But, these should be considered "rule of thumb" dimensions to be used as a starting point and adjustments can be made from there to assure the comfort and usability of the user.

In this planar view, according to certain preferred arrangements the various elements depicted are aligned such that a center line 140 passes through the center of center portion 132 and further through the handles at approximately a central portion of the handle segments 124 and 128 and then to a central area of the paddle blades 104 and 108. As discussed above, the center of the paddle blade may be difficult to define precisely depending on the shape (and is affected by the symmetry and connection point of the paddle arm), but approximately corresponds to the center of mass of a two dimensional planar projection of the paddle shape defining the paddle blade within approximately a central ⅓ of the paddle blade. The center line need not pass precisely through the center of mass or center of gravity, but preferably passes approximately therethrough. However, it will be noted that a functional paddle arrangement consistent with the present teachings can be fabricated in a manner that does not have such center line alignment without departing from the teachings herein.

FIG. 2 depicts a two dimensional planar projection of an example paddle blade whose center of mass is shown as a dot 150. If one defines a central ⅓ of the paddle blade in the vertical and horizontal directions (with vertical being considered along the direction of the paddle arm), the center line 140 preferably passes through this central ⅓ of the paddle blade as shown by the dashed lines vertically and horizontally surrounding the center of mass at dot 150.

FIG. 3 depicts an example embodiment of one of the handles 124 and 128. Handle 124 will be used for this example. Handle 124 has a rigid handle segment 160 that connects the paddle arm to the center portion. Each handle 124 and 128 has a handle grip 166 that is configured so that in operation the handles 124 and 128 each have a handle segment 160 that rotates within the handle grip 166 when the crankshaft is cranked. In the implementation depicted, the handle grip can be made of a slick plastic or polymer material (e.g., nylon, polyester, or Polytetrafluoroethylene (PTFE) such as Teflon® brand PTFE) or similar material that readily rotates with low friction with respect to the handle segment 160. In this implementation, the handle grip may be as simple as a cylinder of such material having thickness of approximately 1/16" to 1/64", but this should not be considered limiting. In other implementations, any bearing arrangement including sleeve, roller or ball bearings can be utilized to facilitate the rotation of the handle segments 160 with respect to the handle grips 166. In this manner, the user can manually crank the crankshaft 120 to achieve a paddling action as depicted in FIG. 4.

Handle segments 160 with handle grips 166 having length 126 of about three to six inches (depending upon the size of the user's hand) and about 1¼ to 1½ inches in diameter have been found to be generally comfortable. But, the handle grips are preferably sized for ease of gripping and comfort of the user based on the size of the user's hands.

Figure 4:
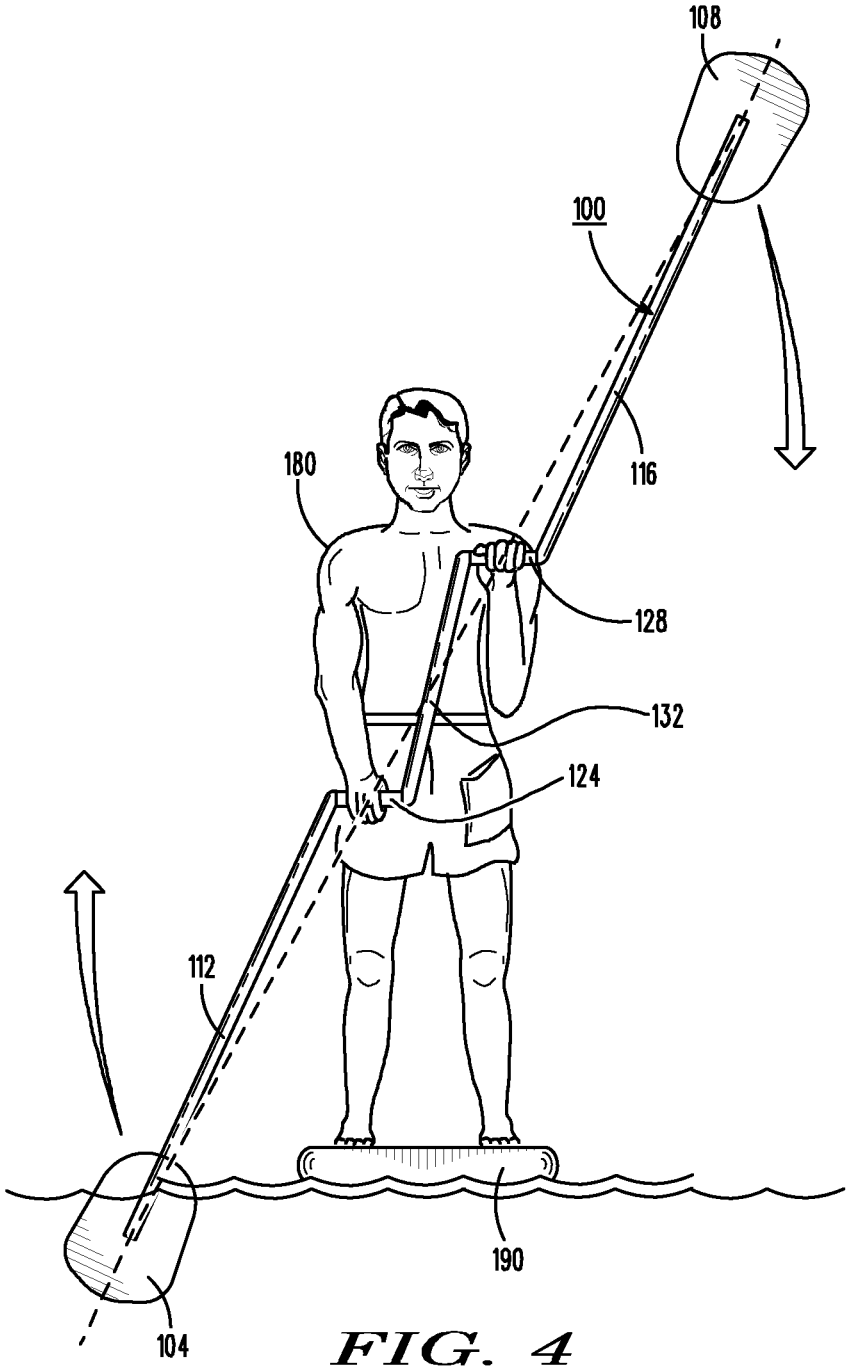
FIG. 4 is an example of an implementation of a paddle in use by a user in a manner consistent with certain embodiments of the disclosure.

FIG. 4 shows the paddle 100 in use. In this illustration, a user 180 is depicted on a stand-up surfboard 190 floating on the water and being propelled by the user using paddle 100. In this example, the user holds the handle grips 124 and 128 in his hands with palms down and simply cranks the crankshaft in a rotational cranking motion about the center of center portion 132 in order to alternately engage paddle blade 104 and 108 in the water thus propelling the surfboard 190. The handle grips are substantially parallel to each other in operation. The handle segments 160 rotate within the handle grips 166 to facilitate the cranking action and allow the user to hold the handle grips keeping his palms down and wrists substantially unbent with the cranking primarily carried out using the elbows and shoulders. In this manner, the paddle blades 104 and 108 alternately engage the water to propel the surfboard 190 forward without the user having to do as much bending and rocking as with a conventional handle. This can make it easier for the user to maintain balance (since little rocking and bending of the body is used) while learning to paddle and can reduce the amount of energy that is expended to propel the surfboard 190 or other vessel.

Referring back to FIG. 1 viewed simultaneously with FIG. 4, it is desirable to establish the length of the center section L1 along with the angles $\phi$ and $\theta$ to achieve a comfortable cranking action. The lengths and angles L1, L2, $\phi$ and $\theta$ are not fully independent and variation of any or all of the lengths and angles may be done to optimally fit a particular user. In determining the lengths and angles for the paddle 100, the angle $\phi$ and length L1 are primarily established to fit the user's arm length so as to permit the user to alternately extend his arms and retract them while cranking so that the cranking action is natural. If L1 is too long, the crankshaft 120 is difficult to crank and may strike the user in the chest; while if L1 is too short, the user loses leverage in the cranking action. L1 should be short enough that the user's arm can be fully extended without the crankshaft hitting the user's body. The angles $\phi$ are selected primarily to cause the handle grips to align perpendicular to the user's arms. A good starting angle for $\phi$ is approximately 105 degrees (typically about 95 to 120 degrees) for a typical adult size paddle with L1 typically being about 22-25 inches or about ⅕ of the full paddle length, but a great deal of variation may exist. Length L1 in combination with angle $\phi$ results in a distance from the handle grips to the user's body that should be shorter than the user's arm while holding the paddle so that the center portion does not hit the user's body during the cranking action. By starting with the length rule of thumb set out above, the length L1 can be adjusted to assure good leverage without striking the user's body. The angles and L2 can be adjusted from there to further assure that the paddle blade strikes the water close to the vessel but avoids the paddle hitting the user's arms or shoulders.

The angle between the handle segments and the center portion, and the length of the center portion are configured to permit the user to extend his or her arms directly in front of him or her and keep the wrists almost stationary in a substantially neutral position without excessive bending for improved ergonomics. The angle $\phi$ between the handle segment and the center portion is also preferably greater than 90 degrees so as to minimize pivoting of the wrist and elbow and is preferably between about 95 and 120 degrees, and most preferably about 112 degrees plus or minus 2-3 degrees. While 90 degrees will work for this angle $\phi$ with a short enough central portion, shortening this central portion and making this angle smaller will bring the paddle arms close to the user's body and could require more body movement to manipulate as well as increasing the likelihood of the paddle arms hitting the user's sides.

A typical starting length L2 and angle $\theta$ for a typical adult size can be approximately 44-48 inches and preferably about 115 degrees plus or minus about 2-3 degrees (but can typically range from approximately 100 degrees to 125 degrees) respectively. L2 is preferably about ⅖ of the entire paddle length (about twice the length of L1) and should preferably be long enough to engage a majority of the paddle blade with the water when the paddle is in operation without the user having to sway from side to side. L2 is thus dependent somewhat on the height and weight of the user and the depth and width of the vessel being propelled. The angle $\theta$ is selected to prevent the paddle arms from hitting the user's arms or shoulders while paddling while permitting the paddle blade to reach the water close to the surfboard 190 or other vessel so as to maximize the forward thrust without inducing excessive side to side changes in direction of the vessel and without excessive bending or flexing of the wrists. Again, a great deal of variation may exist without departing from implementations consistent with the present with the teachings herein. Furthermore, it is again noted that these lengths and angles are interrelated and change of one may dictate changes in another.

The angle $\theta$ between the paddle arm and the crank shaft may be greater than 90 degrees and preferably between about 100 and 125 degrees, and most preferably about 117 degrees plus or minus 2-3 degrees for attachment of the paddle arm to handle segment for an adult size paddle. This angle can be selected to keep the paddle from hitting the user's arms or shoulders when paddling. While a 90 degree angle or less will work and is within the scope of this teaching, an oblique angle within the above limits is preferred because it provides a sufficiently direct path to the water to feel natural, but is a large enough angle to prevent the user from hitting his body with the paddle arm.

To identify suitable angles and lengths for a particular user, the angle $\phi$ between the center portion L1 and the handle segments L2 should be such that the user's hands naturally align palms down with the paddle handle grips when each arm extends straight out from the body while in use. The center portion can be adjusted for comfort in the paddling motion and to extend the handle grips to a suitable length so that the arm extensions are essentially rotational cranking motions with the arms working in alignment with a natural position such that when the arms are extended (one at a time) they extend straight forward from the body with the palms down and without need for much side to side movement of the palms. This permits the user to engage in a cranking action that involves a circular motion of the arms in front of the user with the user being able to accomplish the cranking motion while pretty much standing upright.

The angle $\theta$ between the crank shaft and the paddle arm (at the handle segment) is selected or adjusted so that while the cranking motion takes place, the paddle arm does not strike the user's body, thus reducing the need for the user to rock side-to-side. However, the angle should also be such that the paddle hits the water close to the watercraft (e.g., surfboard) being paddled. The length L2 should permit the paddle head to readily and preferably substantially engage the water when the crank shaft is cranked.

For a person less than about five feet in height, an approximate length of about eight feet from tip to tip is a good starting point with paddle arm to crankshaft angle (paddle angle) at about 117 degrees and a handle to center portion angle (crankshaft angle) of about 112 degrees.

For a person greater than about five feet six inches in height, an approximate length of about ten feet from tip to tip is a good starting point with paddle angle at about 120 degrees and a crankshaft angle of about 110 degrees. A fixed angle device can be made using these angles for example as depicted in FIG. 1.

While the above dimensions provide a good starting point for many users, a user's personal preferences and mode of use may dictate different dimensions. For example, a user whose objective is to obtain high amounts of leverage may desire a longer center portion—perhaps as long as 36 inches or longer with paddle arm lengths of around 36 inches each (in all cases measured from palm to palm while holding the paddle). This produces a wider gyration of the shoulders hips and torso but an increase in leverage is attained. A person looking to achieve a workout or a racer may prefer such a configuration. In this example, the handles will pass outside the shoulders and hips because the body twists and sways in order to perform a maneuver resembling a swimming crawl stroke. In this example, if the paddle is foldable, it can fold into a compact package of approximately three to four feet in total length.

Figure 5:
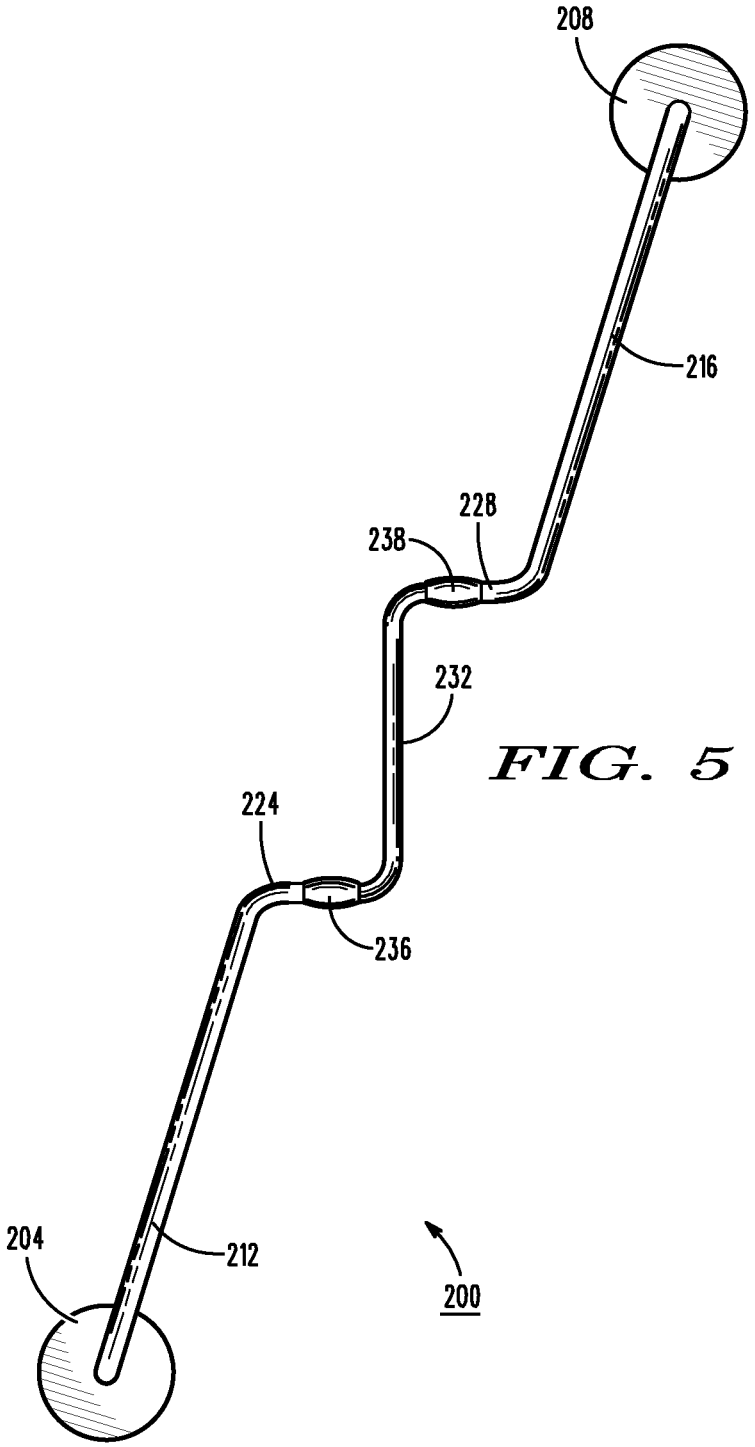
FIG. 5 is another example of an implementation of a paddle consistent with certain embodiments of the disclosure.

Many variations in the paddle 100 can be produced without departing from the present teachings. In most cases, the paddle can be configured to be symmetrical about the center of the center portion 132 to provide for a reduced number of parts along with simplified manufacturing. FIG. 5 shows an example paddle 200 embodying several variations. In this example, a variation in the shape of the paddle blades 204 and 208 is depicted. Paddle blades (or paddle heads) 204 and 208 are shown to be circular with the center of mass at the center of the circular paddle blade. Additionally, while the paddle arms (112, 116), handles (124, 128) and center portion (132) in paddle 100 are shown as straight segments, the paddle arms (212, 216), handles (224, 228) and center portion (232) of paddle 200 are depicted as being formed from a single tube or rod that is bent with smooth curves at the transitions from the handles to the center portion and from the handles to the paddle arms. Handle grips 236 and 238 are provided at handle segments 224 and 228, respectively, with these handle grips being shown in a different configuration with a slightly oval outside profile. Such an embodiment can be realized using handle grips 236 and 238 that are positioned prior to bending the rod or tube used to make the paddle arms (212, 216), handles (224, 228) and center portion (232) of paddle 200, or alternatively, the handle grips 236 and 238 can be installed using any suitable snap fastening, fastener adhesive, welding or other mechanism without limitation. The respective lengths and angles can be similar to those described above.

Figures 6A, 6B:
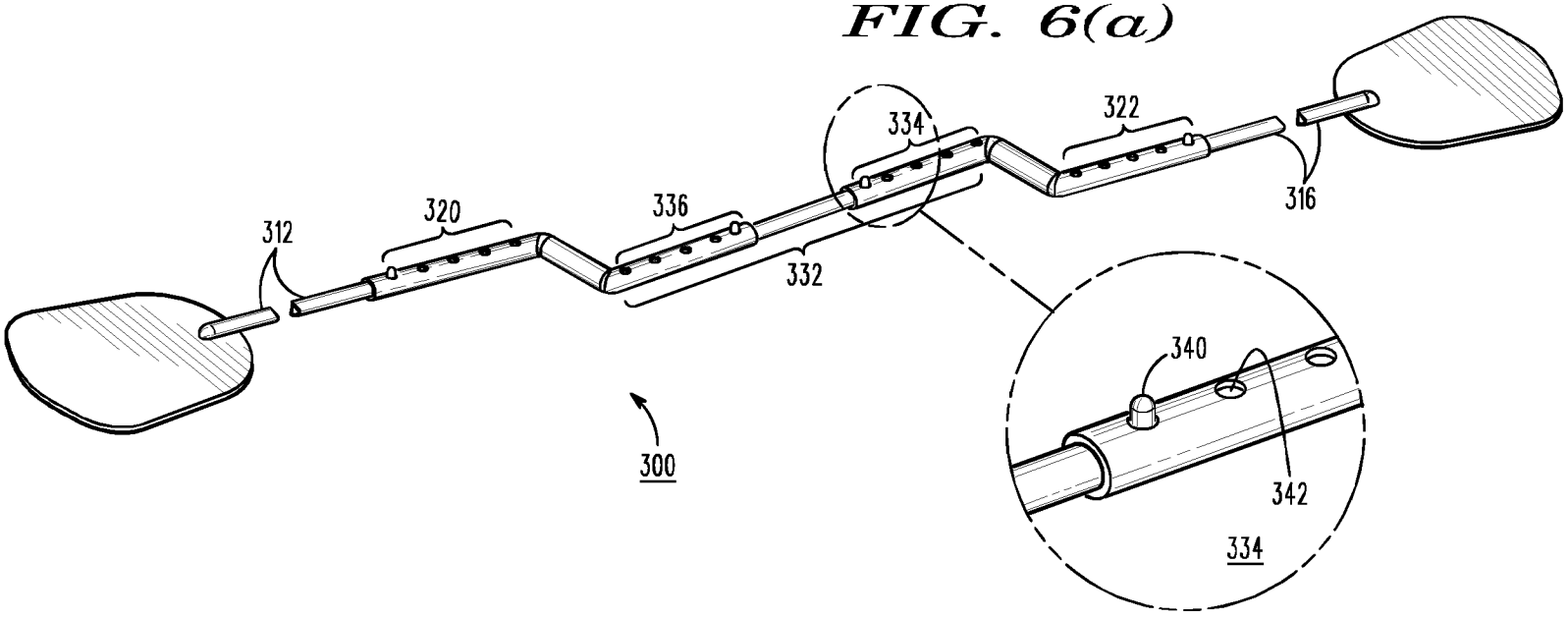
FIG. 6, made up of FIG. 6*a* and FIG. 6*b*, is an example of an implementation of a paddle having adjustable length consistent with certain embodiments of the disclosure, with an example adjustment mechanism shown in detail FIG. 6*b*.

Referring now to FIG. 6*a*, another implementation showing variations is depicted as paddle 300. Various portions of the paddle can be made adjustable to accommodate multiple users of different sizes or having different preferences. In this example, the center portion 332 is adjustable using a spring loaded button-in-hole arrangement as shown in the enlargement of FIG. 6*b*. It is noted that the figures are not to scale and are intended to show several of the many possible variations within the scope of the present discussion. In this version, the center portion 332 can be provided with a spring loaded button at each end in areas 334 and 336. These areas are fitted with spring loaded buttons such as 340 that protrude through a selected hole of any of several holes (e.g., 2 to 5 holes each) in each of two center end segments that engage the center portion 332 at a selected position to enable the center portion 332 to be adjustable in length. With five holes at 1 inch apart, for example, the center portion can be adjusted within a range of four inches at each end in length for a total of eight inches. More or fewer holes can be provided as desired, without limitation. Preferably, the spring loaded button-in-hole is positioned so that at the shortest adjustment position, the inner section is fully inserted into the outer section. Moreover, depending upon the material used, it is preferable that the inner section be inserted within the outer section by an adequate amount to prevent substantial "wobble" of the inner section with respect to the outer section (or vice versa) while in use and provide adequate strength to support vigorous paddling. Those skilled in the art will also appreciate upon considering the present teachings that the tolerances between the inner and outer sections are also preferably taken into consideration to minimize the movement of the inner and outer sections with respect to each other and to provide for a sturdy assembly that approximates unified construction while providing ease of adjustability.

In a smaller sized paddle example, the center portion can be adjustable between about 12 and 18 inches in length (L1) and the paddle arms (L2) can be adjustable between about 3 and 4½ feet in length. In a large size example, L1 can be adjustable between about 18 and 30 inches and L2 can be adjustable between about 36 and 60 inches. Other embodiments can also be implemented without deviation from the present teachings.

In a similar manner, the length of the paddle arms 312 and 316 can be adjusted using similar spring loaded button-in-hole connections shown at 320 and 322. This allows individual adjustment of the length of the paddle arms to accommodate users of varying size. Further, by appropriate positioning of the adjustment, the overall length of the paddle 300 can be shortened so that paddle heads can be interchanged or readily disassembled into a more compact form for carrying, packing, shipping, storing and transport. As above, the inner portion of the paddle arm is preferably fully inserted into the outer portion of the paddle arm when adjusted to the shortest overall length of the paddle arm and more or fewer holes can be provided. Preferably, there are no holes close to the paddle head for maximum strength of the paddle arm. However, those skilled in the art will appreciate that the various dimensions and distances to a first adjustment hole will be dependent upon the tolerance of the inner and outer portions of the paddle arm or center portion and the properties of the materials used. Preferably, the button 340 is located close to the end of the inside tube to provide maximum strength. But, these examples and preferences are not to be considered limiting.

Figure 7:
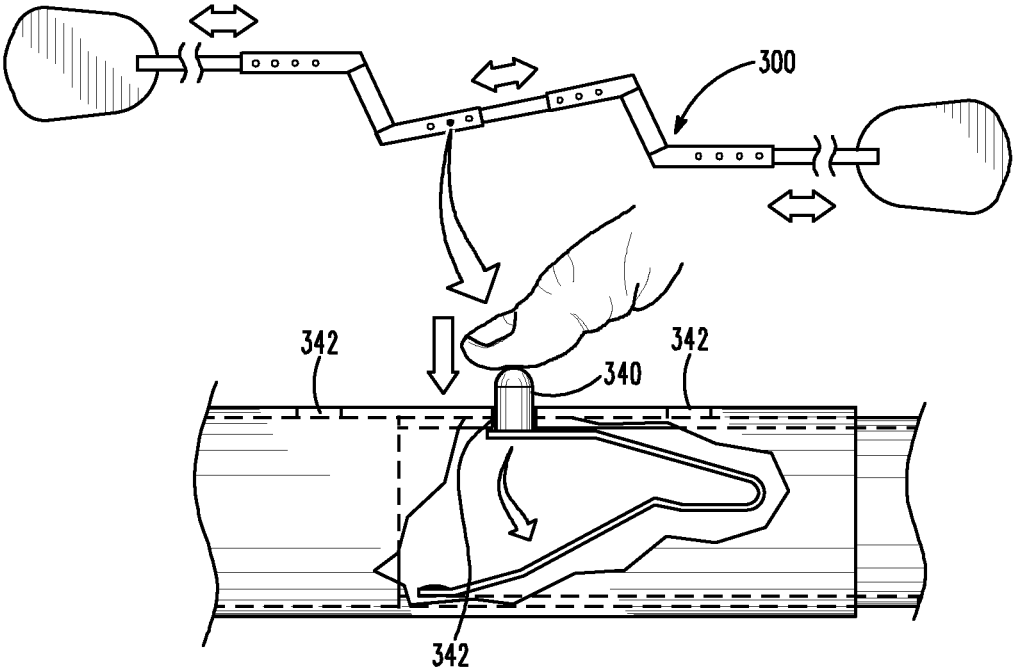
FIG. 7 is a detail of an example of an implementation of a spring loaded button-in-hole length adjustment mechanism as used in a paddle consistent with certain embodiments of the disclosure.
Figure 8:
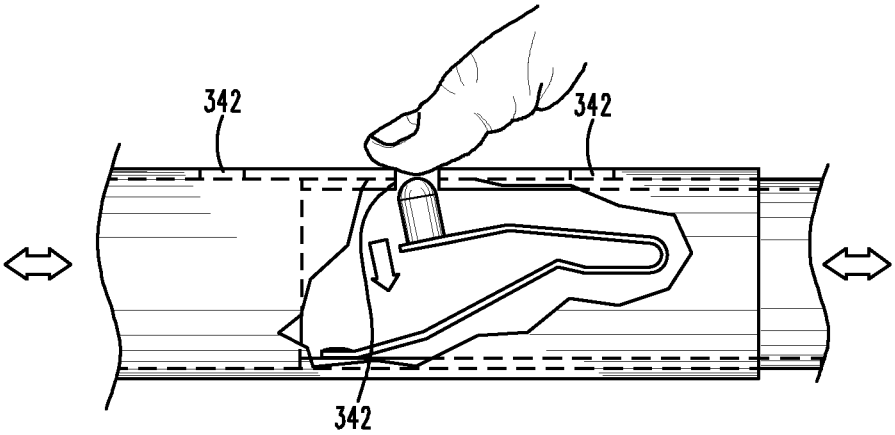
FIG. 8 is another detail of an example of an implementation of a spring loaded button-in-hole length adjustment mechanism as used in a paddle consistent with certain embodiments.

The operation of the spring loaded button-in-hole is further depicted in FIG. 7 and FIG. 8. In FIG. 7 the spring loaded button 340 is shown engaged in one of the holes 342. In FIG. 8, the spring loaded button 340 is pushed below the surface of the inner shaft such as the center portion 332 or paddle arm 312 or 316 to adjust the length. Other known adjustment mechanisms can be used to adjust the length of these parts or paddle 300 without departing from embodiments consistent with the present teachings.

Figures 9A, 9B:
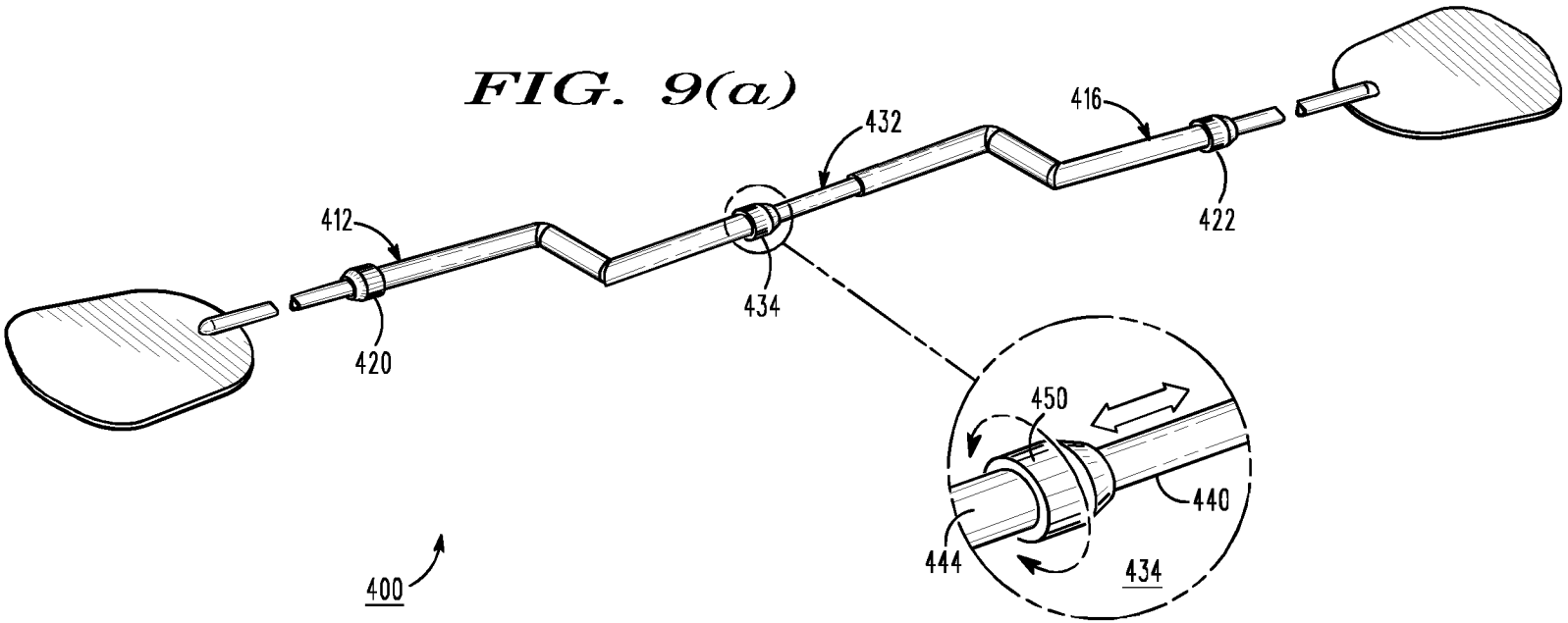
FIG. 9, which is made up of FIG. 9*a* and FIG. 9*b*, is an example of another implementation of an adjustable length paddle using twist locks for length adjustment in a manner consistent with certain embodiments.

Another embodiment of a paddle 400 having adjustable length is depicted in FIG. 9*a*, with the outside of the adjustment mechanism depicted in FIG. 9*b*. In this example, a twist lock that can be any suitable frictional engagement mechanism (such as a friction lock) is utilized to effect the adjustment in length. In this example of depicted paddle 400, the length of each of the paddle arms 412 and 416 is adjusted using twist lock mechanisms 420 and 422 respectively. Similarly, the length of the center portion 432 is adjustable using a similar twist lock mechanism 434 which is shown enlarged in detail drawing FIG. 9*b*. In twist lock mechanisms such as 434, the smaller shaft such as 440 slides within the larger shaft 444 and twisting of the lock mechanism 450 in one direction engages a frictional engagement mechanism such as a cam or a compression fitting to lock the position of the outer shaft 444 with respect to the inner shaft 440. Twisting the frictional engagement mechanism 450 in the other direction disengages the frictional engagement mechanism to permit the shafts 440 and 444 to slide with respect to one another, permitting adjustment of the length. This mechanism can also be used to substantially reduce the size of the paddle 400 for ease of carrying, packing, shipping, storing and transport.

Figures 10A, 10B, 10C:
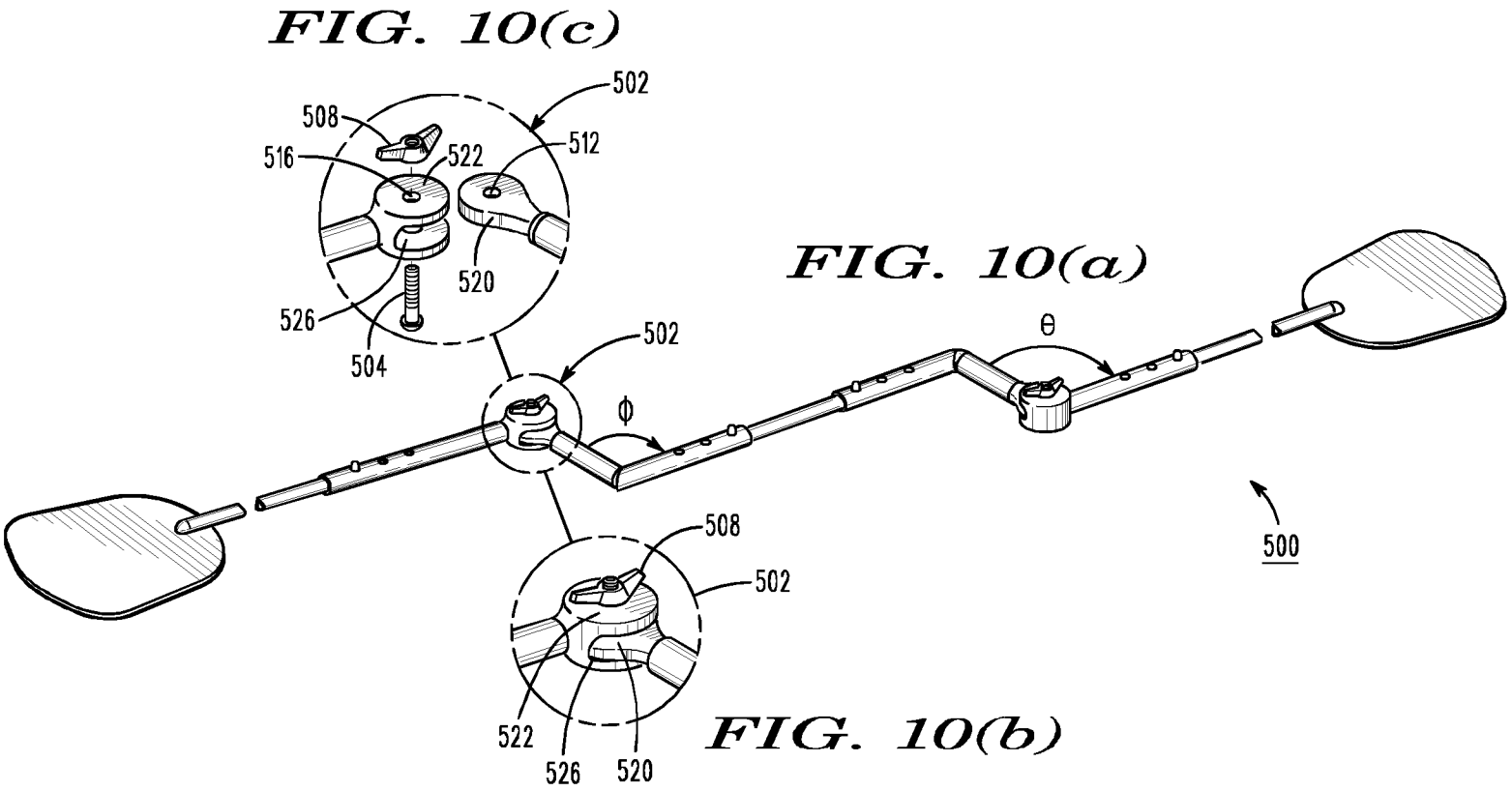
* and FIG. 10*c* depicts an example paddle with adjustable angles consistent with certain implementations as well as adjustable length consistent with certain implementations with angular adjustment detailed in FIG. 10*b* and FIG. 10*c*.

In addition to or instead of adjustments to the length of the paddle, the angles θ and ϕ can also be adjusted as depicted in paddle 500 of FIG. 10*a*. In this implementation, the length of the paddle 500 can be adjusted using spring loaded buttons as in paddle 300. Additionally, the angle ϕ is fixed, but the angle θ can be adjusted as depicted by the adjustment mechanism 502 of FIG. 10*b*. In this mechanism, the central holes can be aligned and nut 508 tightened to a desired angle of θ. A similar mechanism could be employed to make angle ϕ variable instead of or in addition to θ.

Nut 508 is depicted as a wing nut for ease of illustration and in this implementation for ease of adjustment, but could also be a knurled knob. However, other connection mechanisms can be used such as a captive hex nut or threaded member that is engaged by a countersunk Allen head bolt can also be used in order to provide a smoother surface at the adjustment point that is less prone to scratching the user. However, use of such attachment mechanisms will also involve use of a wrench. The surfaces 526 and 520 may include mating teeth to facilitate locking to a particular angle. In other implementations, a square or keyed shaft bolt can be used to make the connection so that the paddle is only assembled in one of several positions including an operational position and a folded position. In another embodiment, two bolts or the like may be used so that the paddle can be assembled in an operational or folded position. It is also noted that using such an adjustment mechanism, the entire paddle arrangement can be rotated about the junction of the handle and the paddle arm (for example) in order to fold the entire paddle into a more compact package for packing, shipping, carrying, storage and transport. It will also be noted that with the configuration shown in FIG. 10*a*, the paddle arms can be interchanged to provide different lengths and interchangeable paddle heads to either change a paddle head or replace a damaged paddle head. Additionally, with the center portion as depicted, the paddle can be readily disassembled into two or more parts for ease of carrying, packing, shipping, storing and transport.

In this example, the adjustment mechanism of FIGS. 10*b* and 10*c* (exploded) can be aligned in any desired position by use of multiple alignment points such as detents or teeth and tightened into place using a bolt 504 and wing nut 508 or other fastener passing through the central holes 512 and 516 (or multiple such holes) of the inner plate 520 and outer plates 522, 526 as shown.

Figures 11A, 11B, 11C:
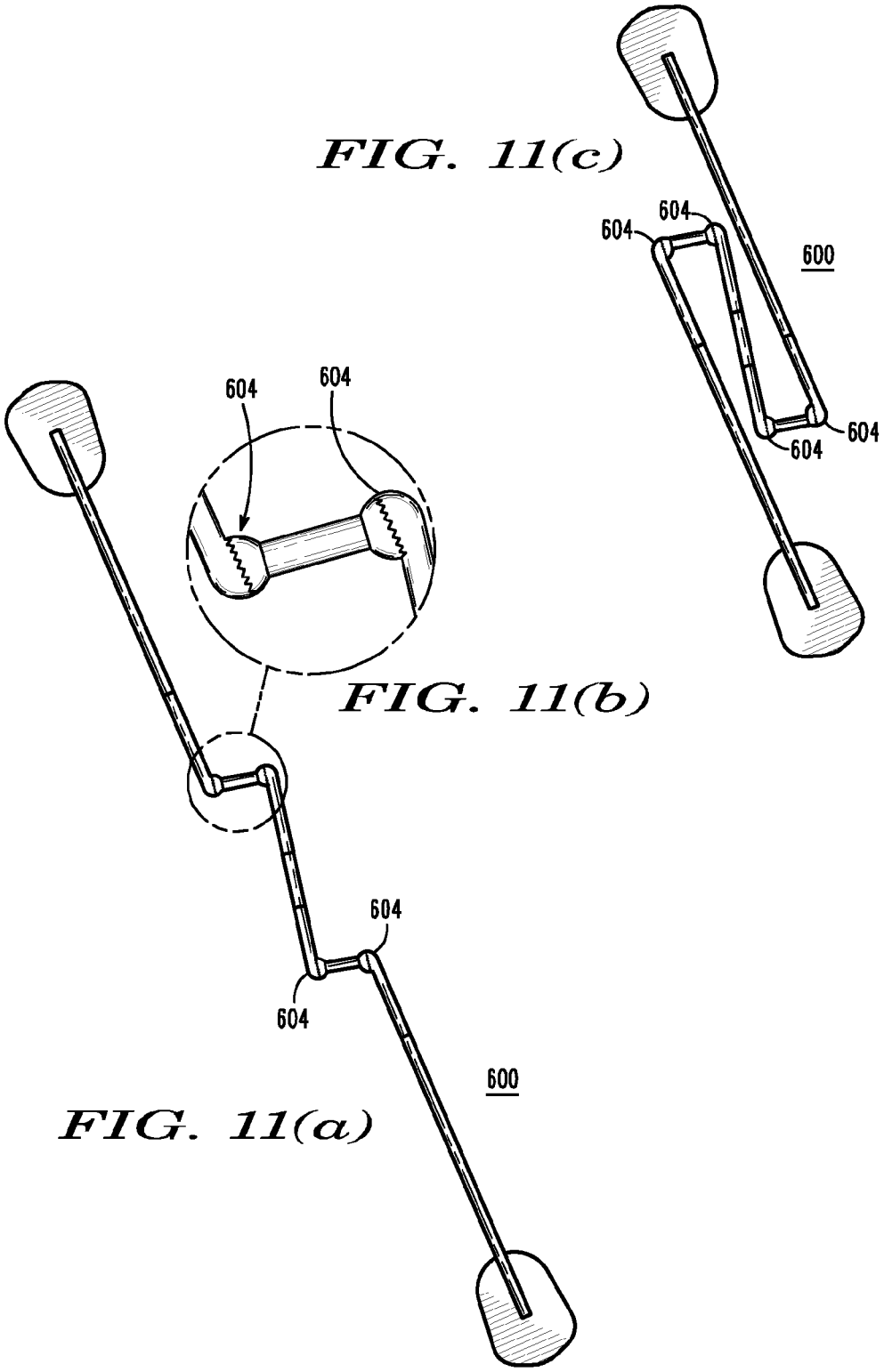
FIG. 11, which is made up of FIG. 11*a*, FIG. 11*b*, FIG. 11*c*, FIG. 11*d*, FIG. 11*e* and FIG. 11*f* depict an example paddle consistent with certain implementations having interlocking teeth adjustments and handle grip variations.

In another implementation depicted as paddle 600 of FIG. 11*a*, the paddle utilizes another type of adjustment mechanism 604 that is shown enlarged in FIG. 11*b*. In this implementation, the paddle when in an operative configuration lies substantially in a single geometric plane. Each of the adjustments shown allow the paddle parts to be rotated through a plane that is normal to this single plane (such single plane containing angle θ and angle ϕ which are fixed in this implementation) to permit folding of the paddle arrangement. (However, a similar mechanism can be used to adjust angles θ and ϕ if re-oriented.) Using this adjustment mechanism, the paddle 600 can be folded, for example, by rotation of two of the joints 604 by 180 degrees to put the paddle into the configuration as shown in FIG. 11*c* so as to make the paddle more compact packing, carrying, shipping, storage and transport.

Figure 11D:
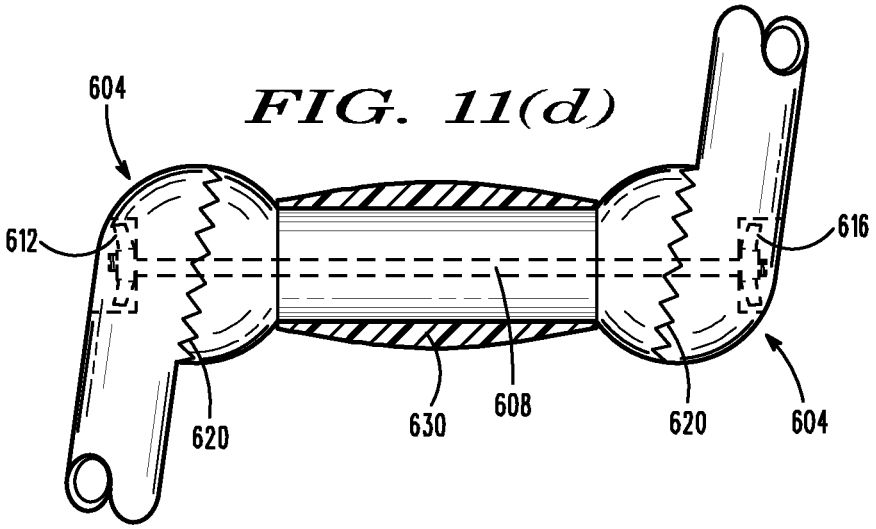
Figure 11E:
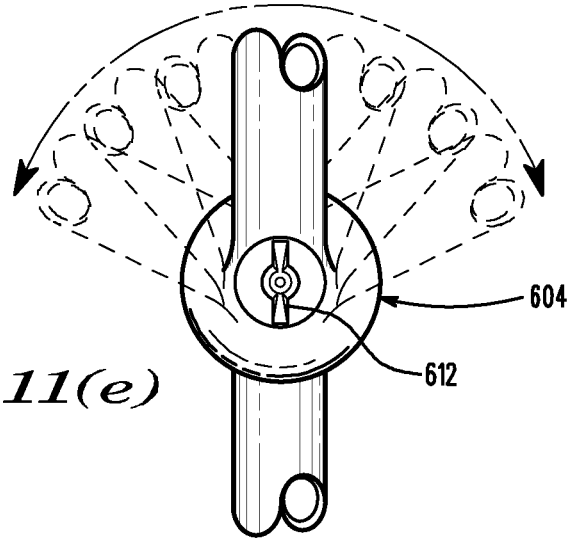
Figure 11F:
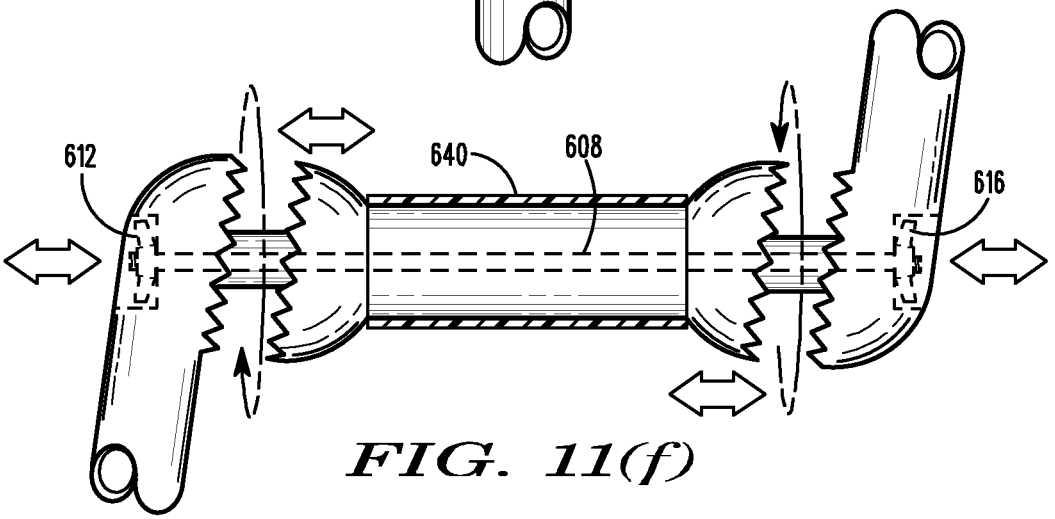

Mechanism 604 is shown in greater detail in FIGS. 11*d*, 11*e* and 11*f*. In this example, a single threaded rod 608 can pass within the handle to each side with a wing nut 612 and 616 at each side used to tighten the adjustment mechanism at any desired position. In other implementations, a single wing nut could also be used at one end with a captive bolt head at the other. Each side of the adjustment mechanism is provided with interlocking teeth 620 that interlock at any of a variety of prescribed angles as shown in FIG. 11*e* and can be rotated to adjust the angle by loosening the wing nuts 612 and 616 as shown in FIG. 11*f* in order to separate the interlocking teeth 620 so that the angle can be adjusted in any of the selected positions permitted by the spacing and number of the teeth 620.

FIG. 11*d* further depicts an example variation in the handle grip 630 in which the handle grip is thicker near the center and tapers off at the edges. Such handle grip rotates freely with respect to the inner handle segment and can be made of any suitable material. FIG. 11*f* further shows a variation in handle grip 640 in which the handle grip 640 is of approximately uniform thickness from end to end.

Figure 12:
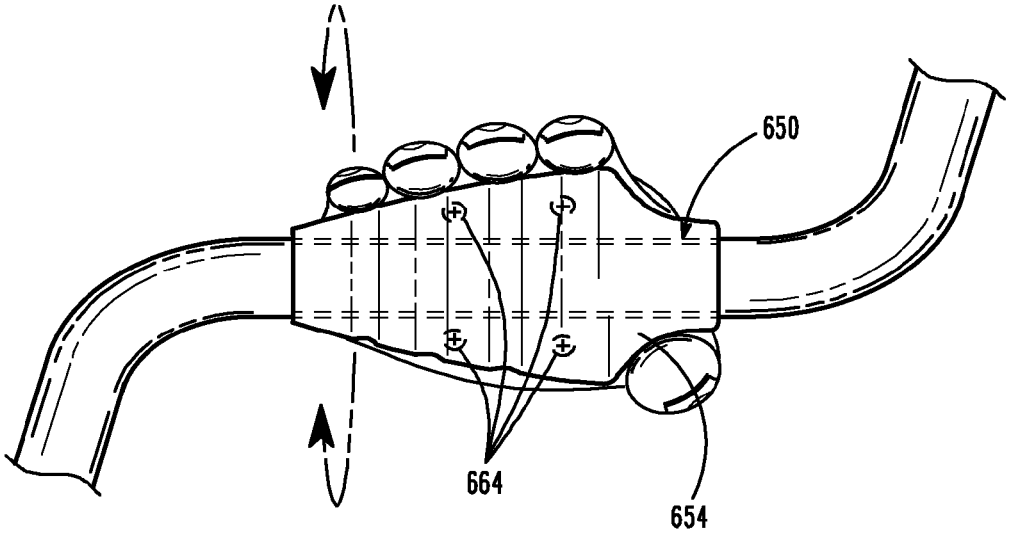
FIG. 12 depicts an example handle grip variation consistent with certain implementations.

A further example variation in the handle grip configuration is depicted in an exaggerated form in FIG. 12 in which the handle grip 650 is configured to have a thicker body that incorporates a recessed area 654 toward the inner side of the paddle with the recessed area 654 serving as an anchor point for the thumb. The handle grip 650 then tapers from large to small diameter from an enlarged area adjacent area 654 to the end closest to the outside of the paddle. This arrangement facilitates gripping the handle grip 650 by providing a measure of pressure from inside to outside between the thumb and the fingers and provides a more ergonomic feel. This, or any other, version of the handle grips can also incorporate recesses to serve as finger grips without departing from the present teachings. This implementation may be adapted to be installed in two pieces using screws 664 to join the halves around each of the paddle's two handle segments. As with the other handle grips depicted, the handle segments rotate freely within these handle grips. While only simple slick plastic bearing surfaces (e.g. resembling sleeve bearings) have been depicted, other bearings such as roller bearings or ball bearings could also be used without limitation. In actual use, the user's hand will preferably wrap more fully around the handle grip 650 than is depicted. Also, handle grip 650 or any other handle grip configuration may include recesses for finger grips as previously noted.

Figure 13:
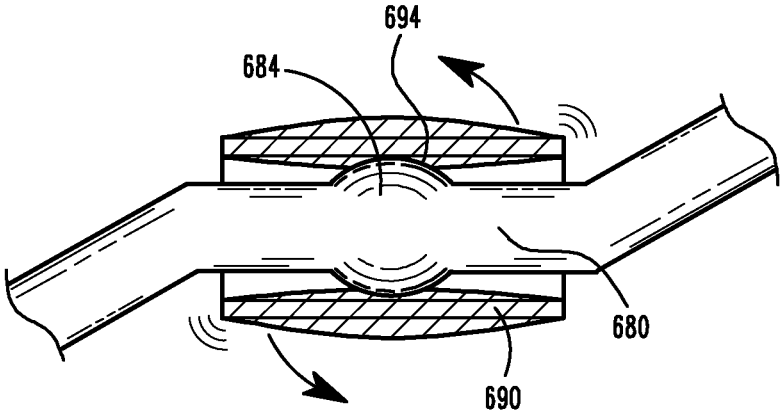
FIG. 13 depicts another example in handle variation using a raised central area to permit pivoting of the handle grip.

In another embodiment of an example handle arrangement shown in FIG. 13, the handle segment 680 can incorporate a raised radial portion 684 at or near the center of the handle segment. The raised radial portion 684 may be integral to the handle segment 680 or a separate part which is attached. A shaped handle grip such as 690 rotates freely with respect to the raised portion so that friction is reduced by a reduction in surface area of contact between the handle grip 690 and the handle segment. In this example, handle grip 690 may incorporate a somewhat tapered outer surface with the widest diameter being at the outer center. On the inside of handle grip 690, there may be a recessed or scooped out portion at 694 that mates with the raised portion 684 to prevent excessive side to side motion of the handle grip 690. This arrangement allows the handle grip 690 to pivot about the raised portion 684 to further reduce the amount of rotation of the user's hands while paddling. Thus, the wrist angle can remain substantially stationary in use without excessive flexing at the wrists with palms down as the handle segments rotate within the handle grips 690.

Figure 14:
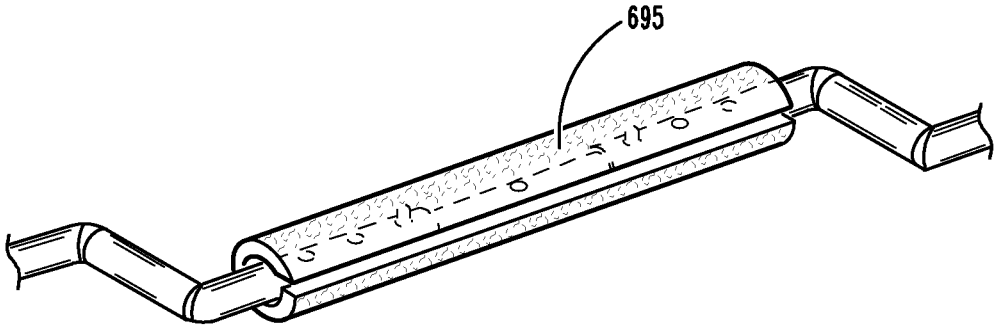
FIG. 14 depicts an example of a paddle having a float attached to a central section thereof.

In the event the paddle is dropped during use, depending upon the material used to manufacture the paddle it may be prone to sinking. As shown in FIG. 14, the paddle may be fitted with a floatation device about one or more of the segments to facilitate retrieval. The floatation device may be, for example, in the form of a hollow foam block or cylinder such as that shown as 695 about the center portion. While a gap is shown in the foam cylinder, it is not required. Other configurations of floatation devices will occur to those skilled in the art upon consideration of the present teachings.

In addition to the variants shown and discussed above, any suitable paddle blade shape can be used. Several non-limiting illustrative examples are depicted in FIG. 15*a* through FIG. 15*g*. FIG. 15*a* depicts an illustrative traditional shaped paddle blade. FIG. 15*b* depicts an illustrative round shaped paddle blade. FIG. 15*c* depicts an illustrative square shaped paddle blade. FIG. 15*d* depicts an illustrative diamond shaped paddle blade. FIG. 15*e* depicts an illustrative tear-drop shaped paddle blade. FIG. 15*f* depicts an illustrative asymmetrical somewhat polygon shaped paddle blade. FIG. 15*g* depicts another illustrative asymmetrical polygon shaped paddle blade.

Figure 16:
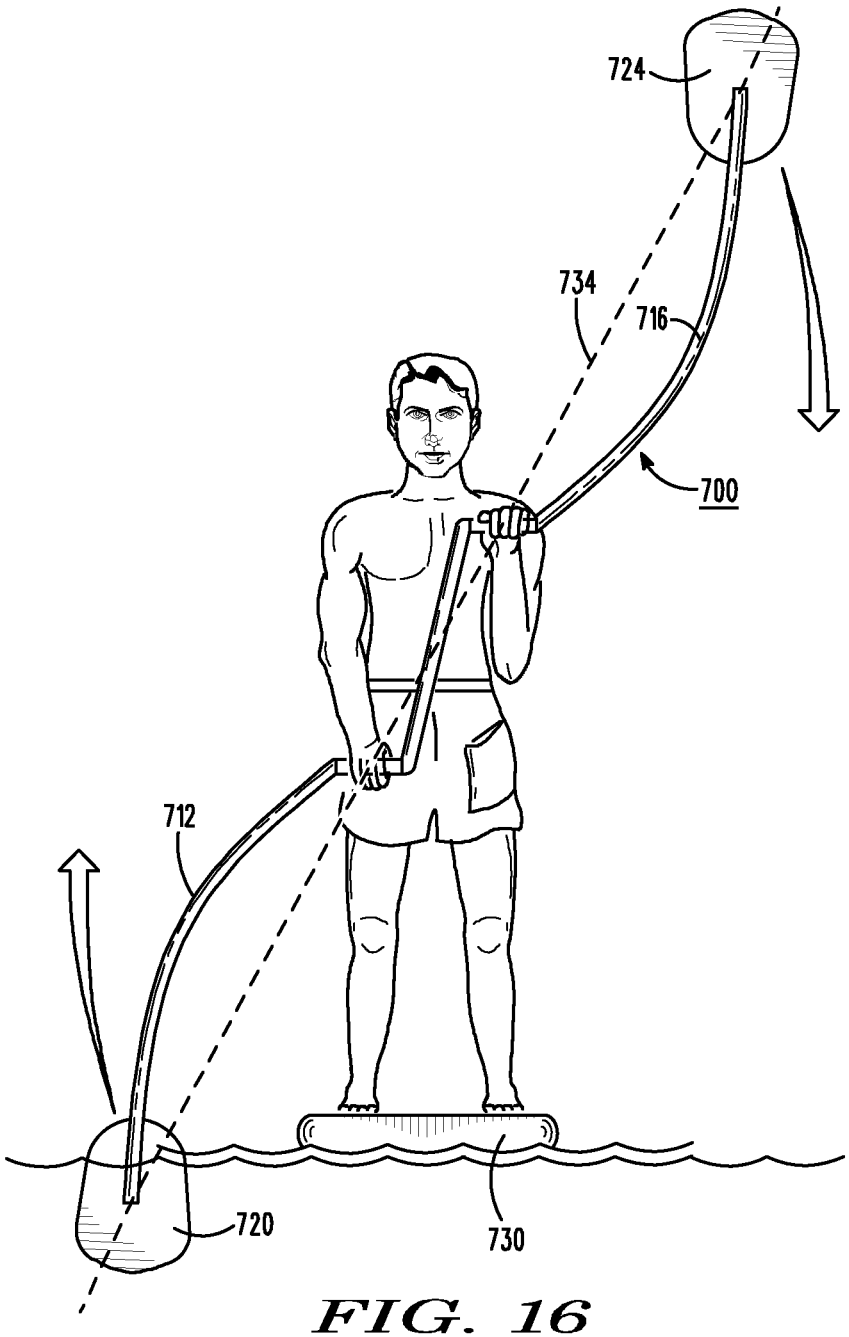
FIG. 16 illustrates an example of a paddle variation having curved paddle arms consistent with certain implementations.

While earlier examples depicted the paddle with essentially linear segments, it is also possible to utilize curved segments as depicted in the example shown in FIG. 16. In this implementation paddle 700 utilizes curved paddle arms 712 and 716. In such an embodiment, the paddle arms 712 and 716 curve to allow the paddle blades 720 and 724 to be close to the surfboard 730 or other vessel so as to obtain a high degree of forward thrust while reducing the likelihood of the paddle arms hitting the user or any raised sides of the user's vessel. It is noted that although the figures depict a user on a stand-up surfboard, any of the present paddle arrangements may be used with any suitable vessel including canoes, outrigger canoes, kayaks or other vessels (some of which may have raised sides); and while depicted as being used while standing, the paddles shown herein can be adapted for use in a seated position without limitation. When used with a vessel having raised sides (e.g., an outrigger canoe), any or all of the angles $\theta$ and $\phi$ can be selected or adjusted along with L1 and L2 as well as a curvature of the paddle arms to assure clearance of the raised sides of such a vessel. In this example, again the center line 734 passes from a central area of each paddle head, through a central area of each handle and the central area of the center portion.

Figure 17:
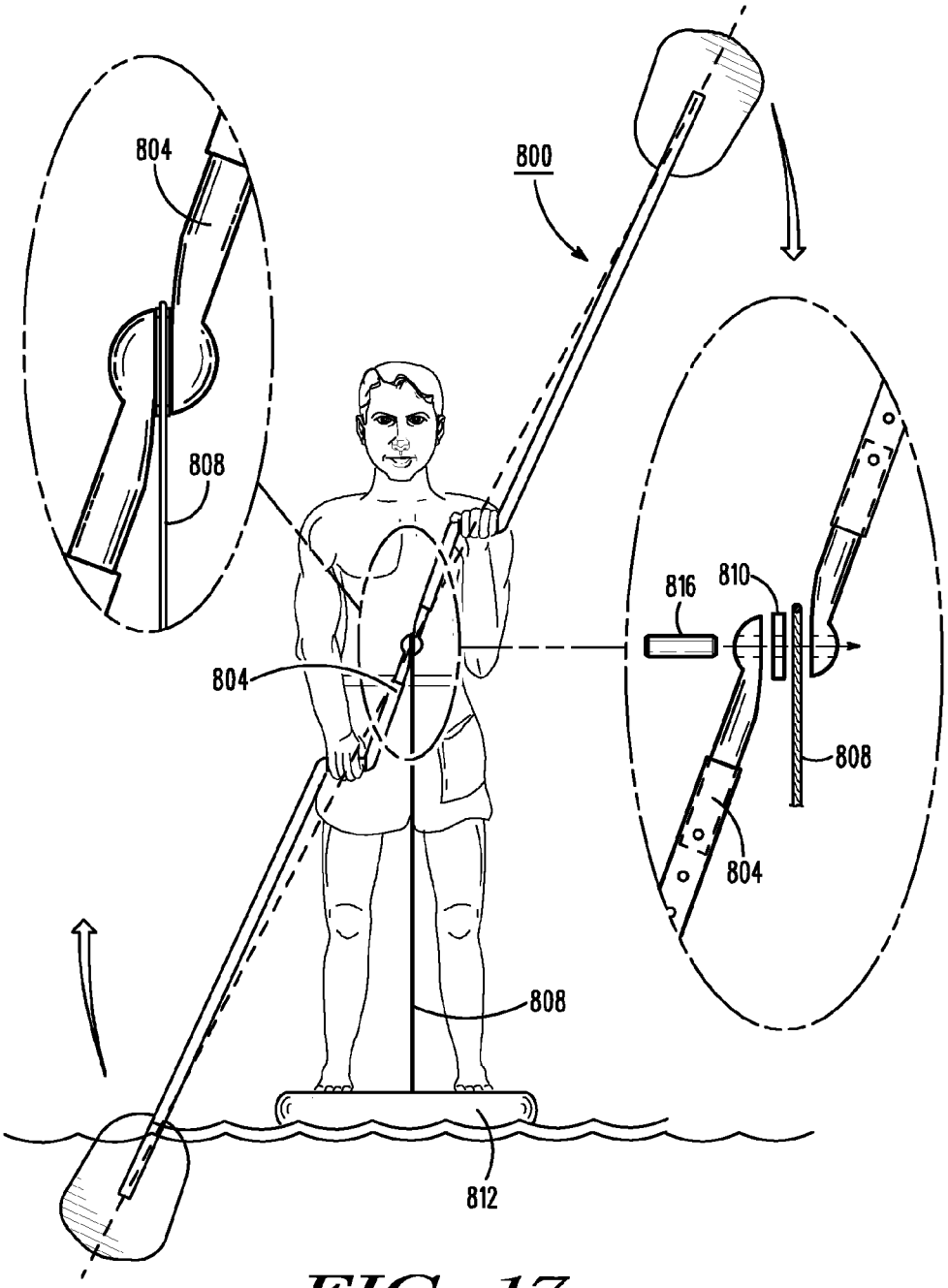
FIG. 17 illustrates an example of a paddle variation having a tether rotatably coupled to the center portion of the paddle in a manner consistent with certain embodiments.
Figure 23:
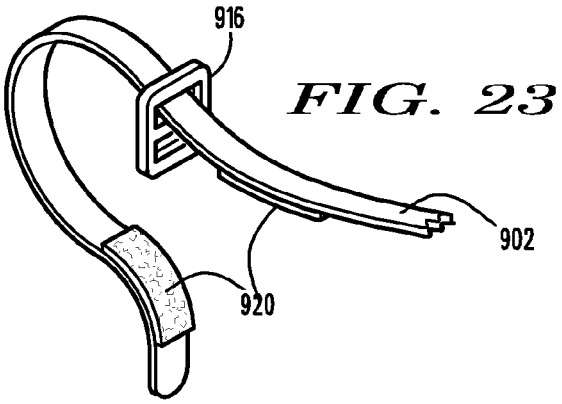
FIG. 23 is a detail of an example of a paddle end of a tether consistent with certain implementations.
Figure 22:
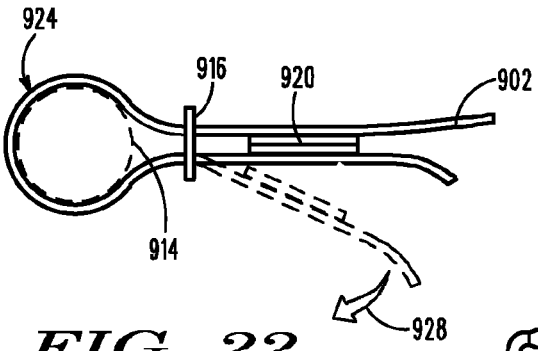
FIG. 22 is a detail of an example of a tether connection to a paddle consistent with certain embodiments.
Figure 21:
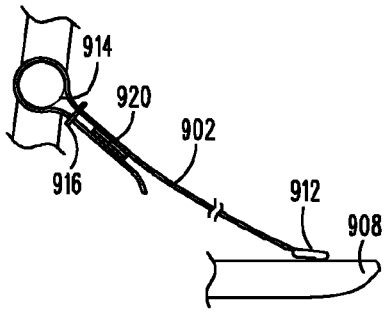
FIG. 21 is an example of a side view of a portion of a paddle tethered to a surfboard using a retraction mechanism in a manner consistent with certain embodiments.
Figure 20:
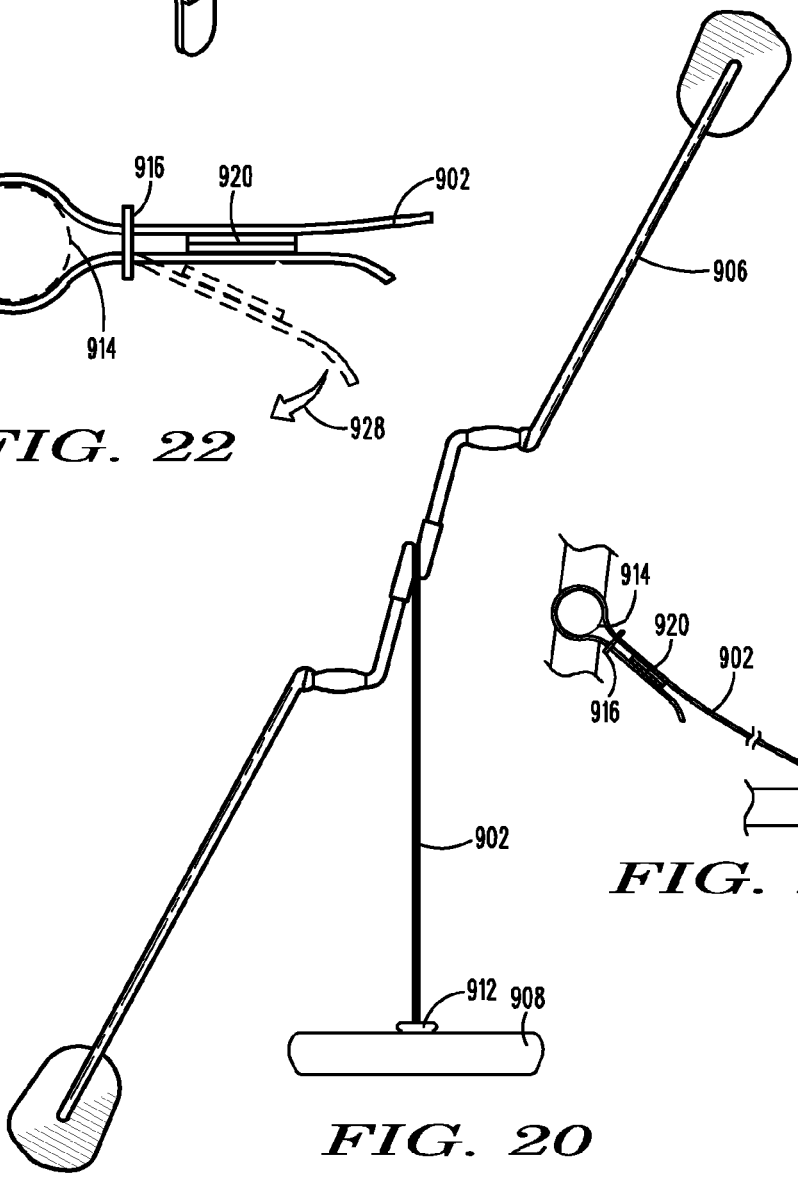
FIG. 20 illustrates another example embodiment of a paddle tethered to a surfboard using a retraction mechanism in a manner consistent with certain embodiments.

Another variation is depicted in FIG. 17. In this variation, the center portion 804 of a paddle 800 is fitted with a tether 808 that is rotatably connected to the center portion 804 and then further connected to the vessel such as surfboard 812 at an area forward of the location where the user stands. This can be implemented in many ways. As depicted in the inset drawings, the tether is wrapped about a rotating central roller 810 that in turn rotates about a shaft 816. In other implementations, a rotating eyelet can be used to secure the tether, or a bearing surface can rotate within a part of the tether 808 or other mechanisms can be used. In any case, the tether allows the user to pull the paddle 800 toward him or her to provide the equivalent of a three point stance in order to further stabilize the user. Moreover, the tethering of the paddle to the surfboard 812 or other vessel results in there being low likelihood in losing the paddle if dropped since the floating vessel is tethered to the paddle.

Another example implementation is depicted in FIG. 18 in which a tethered paddle configuration is shown. In this example, the tether 902 is connected to a surfboard 908 using a patch of hook and loop fastener 912. At the paddle end of tether 902, a loop formed in the tether wraps around a central area of the center portion of paddle 906 as shown in the detail of FIG. 19. In this example, the central area of the center portion has a recessed bearing surface 914 against which the loop of the tether can slide while the bearing surface 914 of the paddle rotates within the loop. As shown in FIG. 18, in this example, the paddle arms can be rotated 180 degrees when not in use for more compact packing, carrying, shipping, storage and transport.

Referring to FIG. 20, FIG. 21, FIG. 22 and FIG. 23, a further example of a tethered paddle is depicted. At the surfboard end of the tether 902, a retraction mechanism 912 is provided to facilitate tangle free storage of the tether 902. The tether 902 can be fabricated using a flat woven fabric such as nylon fabric or the like as is commonly used for dog collars and leashes, for example. The paddle end of the tether can be affixed in place in this example using a retaining member 916 in conjunction with hook and loop fasteners 920 which are engaged with one another to form a loop 924 around the recessed central bearing surface 914. The loop can be disconnected by pulling the tether away as shown by arrow 928 to disengage the hook and loop fasteners 920 and then reengaging fasteners 920 to captivate the retaining member 916 for storage. Retraction mechanism 912 can be permanently or removably affixed to the surfboard 908 by any suitable connection mechanism.

Many other example variations will occur to those skilled in the art upon consideration of the present teachings.

It is noted that in the examples given above, certain examples provide for fixed lengths or adjustable lengths for L1 and L2 as well as fixed angles or adjustable angles $\phi$ and $\theta$.

However, any combination of fixed and adjustable angles can be utilized without limitation. Additionally, while the paddle arms are shown to be generally straight, they can be curved or made up of multiple segments in parallel or connected end to end. Moreover, the center portion can be made of a single segment or multiple connected segments or may be curved in any suitable manner. In certain embodiments, the paddle blades can be configured to be detachable and interchangeable with other paddle blades of differing sizes and/or shapes either with or without a portion of or the entire paddle arm. In such variations, any suitable attachment and detachment mechanism can be implemented without limitation.

Additionally, the paddle heads can be angled such that the paddle blade, when positioned in front of the user while paddling is angled upward while paddling forward. That is, the paddle blade can be angled somewhat forward when it first hits the water while paddling forward and the top end of the paddle points somewhat rearward when it is at the top of the stroke. This arrangement is easily reversed by rotating the paddle on its longitudinal axis if desired. Other angles applied to the paddle blade may also be used. Hence, implementations consistent with the teachings herein can be made by selection of any of the features of the various examples combined with other features of other examples without limitations. Moreover, other mechanisms can be utilized for adjustment of lengths L1 and L2 or adjustable angles $\phi$ and $\theta$ without departing from the present implementation. Many other variations will occur to those skilled in the art without deviating from implementations consistent with the present teachings.

The implementations of the present disclosure described above are intended to be examples only. Those of skill in the art can effect alterations, modifications and variations to the particular example embodiments herein without departing from the intended scope of the present disclosure. Moreover, selected features from one or more of the above-described example embodiments can be combined to create alternative example embodiments not explicitly described herein.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

What is claimed is:

1. A paddle device, comprising:

a first and a second paddle blade;

a crank shaft arrangement comprising:

a first handle segment with a first end and a second end, a center portion having a first end and a second end, and a second handle segment having a first end and a second end, where the first end of the first handle segment is coupled to the first end of the center portion, where the first end of the second handle segment is coupled to the second end of the center portion, and where the first handle segment, second handle segment and the center portion are aligned in substantially the same plane to form the crank shaft arrangement;

a first paddle arm and a second paddle arm, each having first and second paddle arm ends;

where the first end of the first paddle arm is directly attached in a non-rotatable manner to the first paddle blade, and where the second end of the first paddle arm is coupled to the second end of the first handle segment, where the first end of the second paddle arm is directly attached in a non-rotatable manner to the second paddle blade, and where the second end of the second paddle arm is coupled to the second end of the second handle segment; and a first and a second handle grip coupled to the first and second handle segments in a manner that allows the first and second handle segments to rotate within the first and second handle grips respectively, where the angle between the first paddle arm and the first handle segment is user adjustable; and where the angle between the second paddle arm and the second handle segment is user adjustable.

2. The paddle device of claim 1, where the first and second paddle blades are aligned in substantially the same plane as the plane of the crank shaft arrangement.

3. The paddle device of claim 1, where the first and second paddle arms are aligned in substantially the same plane as the plane of the crank shaft arrangement.

4. A paddle device, comprising:

a first and a second paddle structure each having a paddle blade directly attached in a non-rotatable manner and extending from a first paddle arm end of a paddle arm to form first and second paddle structures;

a hand crankable crank shaft arrangement having a center and first and second ends and handle segments, the first end coupled to the first handle segment and the second end coupled to the second handle segment;

where a second paddle arm end of the first paddle structure is attached to the first end of the hand crankable crank shaft arrangement to inhibit rotation between the first paddle structure and the first end of the hand crankable crank shaft arrangement, said attachment at a first angle between the second paddle arm end of the first paddle structure and the first end of the hand crankable crank shaft arrangement that is greater than approximately 90 degrees and less than 180 degrees, and where a second paddle arm end of the second paddle structure is attached to the second end of the hand crankable crank shaft arrangement to inhibit rotation between the second paddle structure and the second end of the hand crankable crank shaft arrangement, said attachment at a second angle between the second paddle arm end of the second paddle structure and the second end of the hand crankable crank shaft arrangement that is greater than approximately 90 degrees and less than 180 degrees; and first and second handle grips rotatably coupled to the hand crankable crank shaft arrangement at the handle segments so as to permit the hand crankable crankshaft arrangement's handle segments to rotate with respect to the first and second handle grips when the hand crankable crankshaft arrangement is cranked.

5. The paddle device of claim 4, where the paddle blades of the first and second paddle structures are aligned in substantially the same plane as the plane of the hand crankable crank shaft arrangement.

6. The paddle device of claim 4, where the paddle arms of the first and second paddle structures are aligned in substantially the same plane as a plane of the hand crankable crank shaft arrangement.

7. A paddle device, comprising:

a first and a second paddle structure each having a paddle blade directly attached in a non-rotatable manner and extending from a first paddle arm end of a paddle arm to form first and second paddle structures;

a hand crankable crank shaft arrangement having a center and first and second ends and handle segments, the first end coupled to the first handle segment and the second end coupled to the second handle segment;

where a second paddle arm end of the first paddle structure is coupled to the first end of the hand crankable crank shaft arrangement and where a second paddle arm end of the second paddle structure is coupled to the second end of the hand crankable crank shaft arrangement; and first and second handle grips rotatably coupled to the hand crankable crank shaft arrangement at the handle segments so as to permit the hand crankable crankshaft arrangement's handle segments to rotate with respect to the first and second handle grips when the hand crankable crankshaft arrangement is cranked, where the second paddle arm ends of the first and second of paddle structures are attached to the hand crankable crankshaft at angles that are user adjustable.

8. The paddle device of claim 7, where the paddle blades of the first and second paddle structures are aligned in substantially the same plane as the plane of the hand crankable crank shaft arrangement.

9. The paddle device of claim 7, where the paddle arms of the first and second paddle structures are aligned in substantially the same plane as a plane of the hand crankable crank shaft arrangement.

10. A paddle device, comprising:

a first and a second paddle blade;

a hand crankable crank shaft arrangement having first and second ends and first and second handle segments;

a first paddle arm and a second paddle arm, where each of the first and second paddle arms have first and second ends, where the first end of the first paddle arm is directly attached to the first paddle blade to inhibit rotation between the first paddle arm and the first paddle blade, and where the second end of the first paddle arm is coupled to the second end of the hand crankable crank shaft arrangement to define a first angle between the second end of the first paddle arm and the second end of the hand crankable crank shaft arrangement that is greater than approximately 90 degrees and less than 180 degrees, and where the second end of the second paddle arm is directly attached to the second paddle blade to inhibit rotation between the second paddle arm and the second paddle blade, and where the first end of the second paddle arm is coupled to the first end of the hand crankable crank shaft arrangement to define a second angle between the first end of the second paddle arm and the first end of the hand crankable crank shaft arrangement that is greater than approximately 90 degrees and less than 180 degrees; and first and second handle grips rotatably coupled to the crank shaft arrangement so as to permit the hand crankable crankshaft arrangement to rotate with respect to the first and second handle grips when the hand crankable crankshaft arrangement is cranked.

11. The paddle device of claim 10, where the first and second paddle blades are aligned in substantially the same plane as the plane of the hand crankable crank shaft arrangement.

12. The paddle device of claim 10, where the first and second paddle arms are aligned in substantially the same plane as a plane of the hand crankable crank shaft arrangement.

13. A paddle device, comprising:

a first and a second paddle blade;

a hand crankable crank shaft arrangement having first and second ends and first and second handle segments;

a first paddle arm and a second paddle arm, where each of the first and second paddle arms have first and second ends, where the first end of the first paddle arm is directly attached in a non-rotatable manner to the first paddle blade, and where the second end of the first paddle arm is coupled to the second end of the hand crankable crank shaft arrangement, and where the second end of the second paddle arm is directly attached in a non-rotatable manner to the second paddle blade, and where the first end of the second paddle arm is coupled to the first end of the hand crankable crank shaft arrangement; and first and second handle grips rotatably coupled to the crank shaft arrangement so as to permit the hand crankable crankshaft arrangement to rotate with respect to the first and second handle grips when the hand crankable crankshaft arrangement is cranked, where the second end of the first paddle arm is coupled to the second end of the hand crankable crank shaft arrangement at a third angle, and where the first end of the second paddle arm is coupled to the first end of the crank shaft arrangement at a fourth angle, and where the third and fourth angles between first and second paddle arms and the hand crankable crank shaft arrangement are adjustable.

14. The paddle device of claim 13, where the first and second paddle blades are aligned in substantially the same plane as the plane of the hand crankable crank shaft arrangement.

15. The paddle device of claim 13, where the first and second paddle arms are aligned in substantially the same plane as a plane of the hand crankable crank shaft arrangement.

16. A paddle device, comprising:

a first and a second paddle blade;

a hand crankable crank shaft arrangement having first and second ends and first and second handle segments;

a first paddle arm and a second paddle arm, where each of the first and second paddle arms have first and second ends, where the first end of the first paddle arm is directly attached in a non-rotatable manner to the first paddle blade, and where the second end of the first paddle arm is coupled to the second end of the hand crankable crank shaft arrangement, and where the second end of the second paddle arm is coupled to the second paddle blade, and where the first end of the second paddle arm is directly attached in a non-rotatable manner to the first end of the hand crankable crank shaft arrangement; and first and second handle grips rotatably coupled to the crank shaft arrangement so as to permit the hand crankable crankshaft arrangement to rotate with respect to the first and second handle grips when the hand crankable crankshaft arrangement is cranked, where a first end of the first handle segment is coupled to a first end of a center portion of the hand crankable crank shaft arrangement at a first angle, a first end of the second handle segment is coupled to a second end of the center portion of the hand crankable crank shaft arrangement at a second angle, and the first and second angles are user adjustable.

17. The paddle device of claim 16, where the first and second paddle blades are aligned in substantially the same plane as the plane of the hand crankable crank shaft arrangement.

18. The paddle device of claim 16, where the first and second paddle arms are aligned in substantially the same plane as a plane of the hand crankable crank shaft arrangement.

* * * * *